US009949541B2

(12) United States Patent
Kantor et al.

(10) Patent No.: US 9,949,541 B2
(45) Date of Patent: Apr. 24, 2018

(54) COMBINATION CELL PHONE AND EYEGLASS CASE

(71) Applicants: Philip A Kantor, Las Vegas, NV (US); Connie R Masters, Henderson, NV (US); Milton Friedman, Cedarhurst, NY (US); Rivka T Friedmam, Cedarhurst, NY (US)

(72) Inventors: Philip A Kantor, Las Vegas, NV (US); Connie R Masters, Henderson, NV (US); Milton Friedman, Cedarhurst, NY (US); Rivka T Friedmam, Cedarhurst, NY (US)

( * ) Notice: Subject to any disclaimer, the term of this patent is extended or adjusted under 35 U.S.C. 154(b) by 773 days.

(21) Appl. No.: 14/467,038

(22) Filed: Aug. 24, 2014

(65) Prior Publication Data

US 2014/0360898 A1 Dec. 11, 2014

Related U.S. Application Data

(63) Continuation-in-part of application No. 13/215,181, filed on Aug. 22, 2011, now abandoned, which is a continuation-in-part of application No. 12/713,965, filed on Feb. 26, 2010, now abandoned.

(51) Int. Cl.

| | |
|---|---|
| ***A45C 11/04*** | (2006.01) |
| ***A45F 5/02*** | (2006.01) |
| ***A45C 15/00*** | (2006.01) |
| *A45C 11/00* | (2006.01) |
| *A45F 5/00* | (2006.01) |

(52) U.S. Cl.

CPC ..... *A45C 11/04* (2013.01); *A45C 11/00* (2013.01); *A45C 15/00* (2013.01); *A45F 5/02* (2013.01); *A45F 5/021* (2013.01); *A45C 2011/002* (2013.01); *A45F 2005/008* (2013.01); *A45F 2200/0541* (2013.01)

(58) Field of Classification Search

CPC ..... A47C 7/62; A45C 11/04

USPC ..... 206/320, 5, 6; 383/38, 40

See application file for complete search history.

(56) References Cited

U.S. PATENT DOCUMENTS

| | | | |
|---|---|---|---|
| 746,013 | A | 12/1903 | Burton |
| 2,426,843 | A | 9/1947 | Phair et al. |
| 3,583,612 | A | 6/1971 | Theodore |
| 4,279,681 | A | 7/1981 | Klimszky |
| 5,002,401 | A | 3/1991 | Blackman |

(Continued)

FOREIGN PATENT DOCUMENTS

| | | |
|---|---|---|
| DE | 9314714.7 | 3/1995 |
| WO | 03056970 A1 | 7/2003 |

*Primary Examiner* — King M Chu

(74) *Attorney, Agent, or Firm* — Connie R. Masters

(57) ABSTRACT

A trim, compact combination case dedicated to storing a cell phone (or other small electronic device) and an accessible pair of eyeglasses is disclosed. The combination cell phone and eyeglass case includes a phone housing compartment and an adjacent eyeglass/storage compartment, which are configured to hold a cell phone and eyeglasses side by side. An aspect includes a transparent access window by which a user can view and contact the front touchscreen of an enclosed phone. The compact design allows the combination case to be easily carried in a bag, purse, briefcase or pocket. The combination case advantageously positions the eyeglasses oriented and located for quick retrieval when needed to view the phone screen or buttons.

21 Claims, 23 Drawing Sheets

(56) References Cited

U.S. PATENT DOCUMENTS

| | | | | |
|---|---|---|---|---|
| 5,006,699 | A | 4/1991 | Felkner et al. | |
| 5,615,768 | A | 4/1997 | Schermerhorn | |
| D379,262 | S | 5/1997 | Seigel | |
| 5,884,155 | A | 3/1999 | Wicks et al. | |
| 5,933,772 | A | 8/1999 | Wolff | |
| 6,047,752 | A * | 4/2000 | Southwick | A45C 3/00 150/112 |
| 6,264,029 | B1 | 7/2001 | Motson | |
| 6,273,310 | B1 | 8/2001 | Gregory | |
| 6,389,268 | B1 | 5/2002 | Snyder | |
| 6,424,823 | B1 | 7/2002 | Moles | |
| 6,668,882 | B1 | 12/2003 | Cazes | |
| 6,729,467 | B1 | 5/2004 | King | |
| 6,823,909 | B1 | 11/2004 | Marsteller | |
| 6,857,518 | B2 | 2/2005 | Chao | |
| 6,892,880 | B2 | 5/2005 | Nieves | |
| 7,194,289 | B1 | 3/2007 | Flores, Jr. | |
| 7,231,038 | B2 | 6/2007 | Warren | |
| D548,959 | S | 8/2007 | McClain | |
| 7,293,635 | B2 | 11/2007 | Repke et al. | |
| 7,467,695 | B2 * | 12/2008 | Gormick | A45C 3/02 190/102 |
| 7,503,440 | B2 | 3/2009 | Gormick et al. | |
| 7,539,513 | B2 | 5/2009 | Cathey, Jr. et al. | |
| 7,548,386 | B2 | 6/2009 | Huang | |
| 7,597,225 | B2 | 10/2009 | Badillo et al. | |
| 2003/0029754 | A1 | 2/2003 | Scicluna | |
| 2003/0164216 | A1 | 9/2003 | Starr | |
| 2004/0085694 | A1 | 5/2004 | Germagian et al. | |
| 2005/0121121 | A1 | 6/2005 | Wang | |
| 2005/0173268 | A1 | 8/2005 | Boyette | |
| 2005/0194267 | A1 | 9/2005 | Lam | |
| 2005/0241972 | A1 | 11/2005 | Hassett | |
| 2006/0105821 | A1 | 5/2006 | Goradesky et al. | |
| 2006/0276220 | A1 | 12/2006 | Schure | |
| 2007/0044877 | A1 | 3/2007 | Davidoff et al. | |
| 2007/0113306 | A1 | 5/2007 | Paci et al. | |
| 2007/0151870 | A1 | 7/2007 | Boyette | |
| 2008/0035523 | A1 | 2/2008 | Lemire | |
| 2009/0010575 | A1 | 1/2009 | Sanka | |
| 2009/0141886 | A1 | 6/2009 | Pierson | |

* cited by examiner

COMBINATION CELL PHONE AND EYEGLASS CASE

FIELD OF INVENTION

The present invention relates generally to cases and carriers, and more particularly, to a compact case with dual compartments for storing a cell phone and eyeglasses.

BACKGROUND INFORMATION

The cell phone has become a ubiquitous personal accessory. It fulfills the need not only for communication, but also performs an ever-increasing number of functions that make life more efficient and enjoyable. New cell phone applications, with ever expanding functionality, are being rapidly developed, thus adding to the dominance of the cell phone in modern electronic life.

It is now possible for cell phones to provide extensive functionality in a very small form factor that is convenient to carry. Yet the miniaturization of cell phones necessitates that the display screen also be small, even if the display is designed to occupy the entire front of the cell phone. Entire documents or spreadsheets may need to be read on this small screen. For some people the text, icons and images of the screen, as well as any buttons on the device, may be difficult to see clearly. Especially as the population is aging, presbyopia (the loss of the ability to clearly see close objects) is increasing, which results in more cell phone users needing to locate their reading glasses to use the phone effectively. Often there is pressure to retrieve the glasses quickly, such as to determine the identity of the caller or answer the phone while ringing.

Currently many cell phone users store their cell phones and eyeglasses in separate cases within a bag, purse or briefcase. Significant inconvenience and annoyance may ensue as a user rummages through his or her bag attempting to quickly locate both separate cases, struggling to hurriedly open both cases, and then endeavoring to disengage both the cell phone and the eyeglasses from their individual cases within a short time period.

Other cell phone users opt to use a multipurpose bag with numerous compartments to store the cell phone along with other small electronic devices or personal items. Such multipurpose bags are disclosed in several patents and patent applications, such as U.S. Pat. No. 7,293,635 issued to Repke, U.S. Pat. Nos. 7,467,695 and 7,503,440 to Gormick, U.S. Pat. No. 6,857,518 to Chao, U.S. Pat. No. 6,264,029 to Motson, U.S. Patent Publication No. 2005/0194267 to Lam, and U.S. Patent Publication No. 2003/0029754. While some of the various general compartments are suitable for holding a cell phone and eyeglasses, the generic compartments do not lend themselves to quick and easy access. Many multipurpose bags are also encumbered with shoulder straps, flaps with closures, zippers, snaps or other encumbrances that restrict or interfere with quick retrieval of the phone and glasses. Nor are the multi-purpose bags simple and uncomplicated to construct. None provide a streamlined case allowing a user to quickly access both the eyeglasses and phone, permitting a user to conveniently store the compact case, and enabling efficient manufacture.

Additionally available are eyeglass cases or phone cases that include compartments suitable for storing other personal items of various types. Such cases are disclosed in U.S. Patent Publication No. 2005/0173268 to Boyette U.S. Design Pat. No. D548959 to McClain, U.S. Design Pat. No. D379262 to Siegel, U.S. Pat. No. 6,424,823 to Moles, U.S. Patent Publication No. 2007/0113306 to Paci and U.S. Patent Publication No. 2009/0010575 by Sanka. While these disclose the concurrent storage of eyeglasses or phones with other items from mirrors to calculators, none of these successfully present a dedicated, compact storage for a pair of glasses and a phone, while allowing quick, easy and efficient access to both.

Patents for a wide variety of bags and cases are available in this crowded field of art. Each bag is designed to meet a particular need. For example, the mail bag of U.S. Pat. No. 746,013 to Burton presents a mail bag with many transverse pockets (each designed to hold the mail of a single individual) that can be folded onto themselves and rolled into a bag. While this bag and others in this crowded field are satisfactory for their intended purpose, they are not satisfactory for storing a cell phone alongside eyeglasses in a very compact dedicated case that is easy to stow away within a crowded purse or briefcase.

Another bag is presented by Blackman in U.S. Pat. No. 5,002,401 for an "Article Holder and Carrier." This holder and carrier has an assortment of pockets for holding a variety of articles of varying sizes and shapes, which can be folded into a carrier. Though this holder and carrier may fit the need of a student to carry pencils, glue, scissors, paper and other schools supplies, it is not suitable for containing eyeglasses with a cell phone. Its numerous pockets and structures involved with its self-folding and carrying abilities cause the Blackman holder to be bulky and to take time to open to retrieve items. When receiving an incoming phone call, it may be difficult to extract both a cell phone and a pair of glasses stored within the Blackman bag before the call ends or is routed to voice mail.

Accordingly, though a diverse array of cases are available that can potentially hold a cell phone and a pair of eyeglasses, the available cases do not meet the need for a compact, efficiently usable case dedicated to storing a mobile phone and conveniently located eyeglasses, while providing quick and easy retrieval of both items.

SUMMARY OF THE INVENTION

The present invention is directed to a trim, compact combination case dedicated to storing a cell phone and a readily accessible pair of eyeglasses. The combination cell phone and eyeglass case includes a phone housing compartment and an adjacent eyeglass/storage compartment. The combination case advantageously positions both the phone and the eyeglasses oriented and located for quick access and retrieval.

Thirteen embodiments are disclosed. Six of the embodiments provide a phone case with an eyeglass case attached to a lateral side of the phone case. The other seven embodiments provide a phone case with an eyeglass case attached to the longitudinal or back side of the eyeglass case. Various additional aspects are also disclosed.

The compact design of the combination case provides benefits for users, manufacturers and/or retailers. The lightweight, compact design provides economy of space, allowing the combination case to be easily carried in (and retrieved from) bags, purses, briefcases, and pockets. The combination case allows access to and/or quick retrieval of either, or both, the phone and eyeglasses.

An object of the present invention is to provide a combination cell phone and eyeglass case that conveniently holds a cell phone and a pair of eyeglasses in a manner in which they are easy to quickly extract for use.

A further object of the present invention is to provide a combination cell phone and eyeglass case that is trim and compact.

An additional object of the present invention is to provide a combination cell phone and eyeglass case that allows a user to keep eyeglasses handy and readily available, when needed.

A further object of the present invention is to provide a combination cell phone and eyeglass case that can be easily inserted into a case, bag, purse, briefcase or pocket.

These and other objects, features and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE PREFERRED EMBODIMENTS

Figure 1:
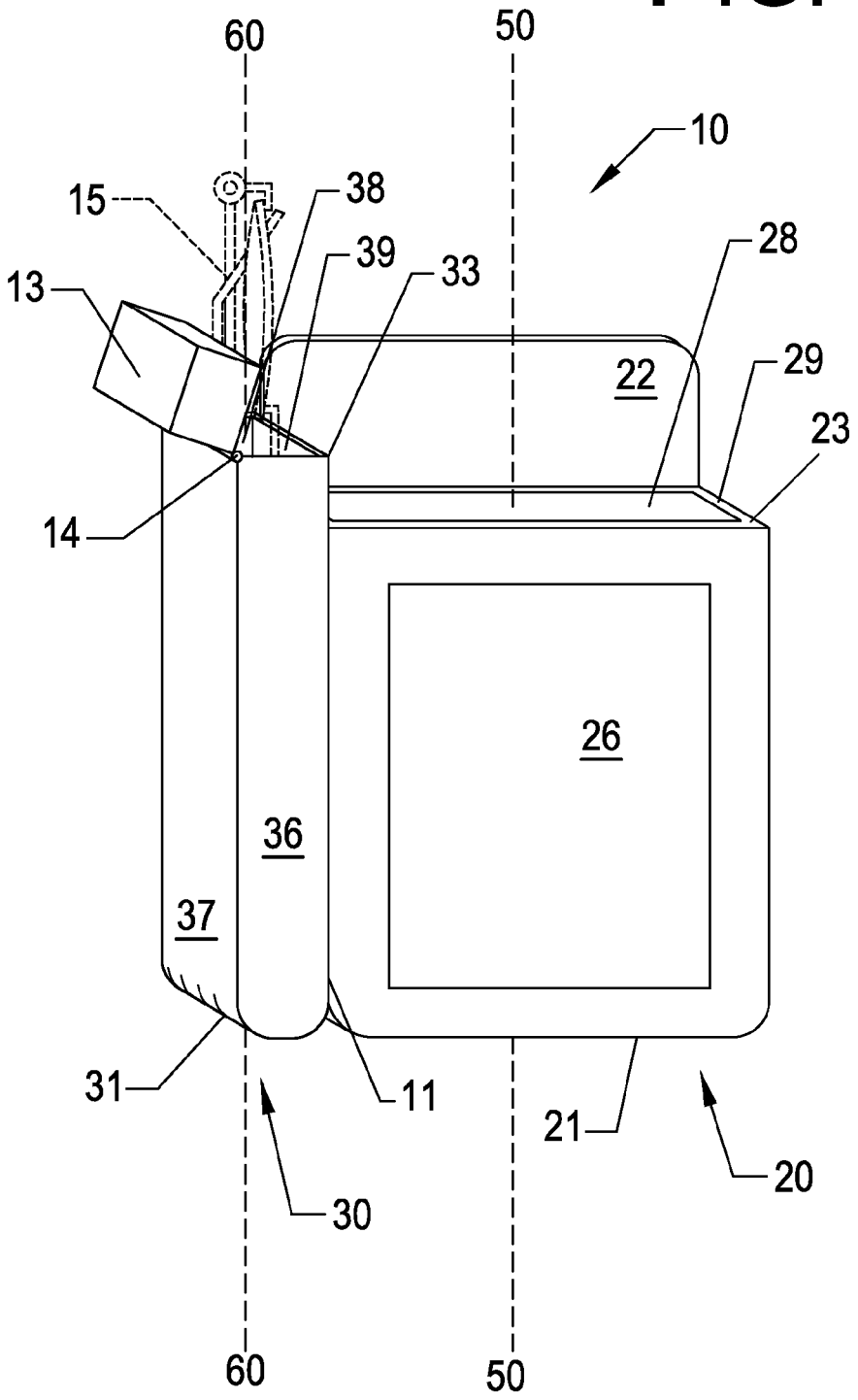
FIG. 1 is a perspective view showing a first embodiment of the combination cell phone and eyeglass case of the present invention.

Shown throughout the figures, the present invention is directed toward a combination cell phone and eyeglass case, shown generally as reference number 10. The combination case 10 has a trim, compact design focused on holding a pair of eyeglasses in a readily accessible position for quick retrieval so they are close at hand when needed to provide a better view of the phone screen and/or phone controls. The combination case 10 includes both a phone housing compartment 20 dedicated to securing a cell phone 25 and an adjoined separate eyeglass/storage compartment 30 designed particularly for housing eyeglasses, but which is optionally usable for storing other personal equipment or accessories.

The phone housing compartment 20 conveniently protects a cell phone 25, yet allows for easy access. The adjacent positioning of the eyeglass/storage compartment 30 keeps the eyeglasses 15 protected, yet handy and easy to reach, if they are needed by the user. Although the phone housing compartment 20 is particularly designed for use with a cell phone 25, it is also suitable for use with other portable consumer electronic devices. Therefore, throughout this disclosure, unless otherwise indicated by context, the term "phone" (and grammatical equivalents) includes any portable consumer electronic device, such as, for example, mobile phones, PDA's, music players, iPods®, smart phones, handheld electronic language translators, tablet computers, and the like. And although the eyeglass/storage compartment 30 is particularly discussed herein as suitable for receiving eyeglasses 15, the eyeglass/storage compartment 30 is also suitable for receiving other personal equipment, gear or paraphernalia, such as earphones, money, a driver's license, credit cards or the like.

Figure 2:
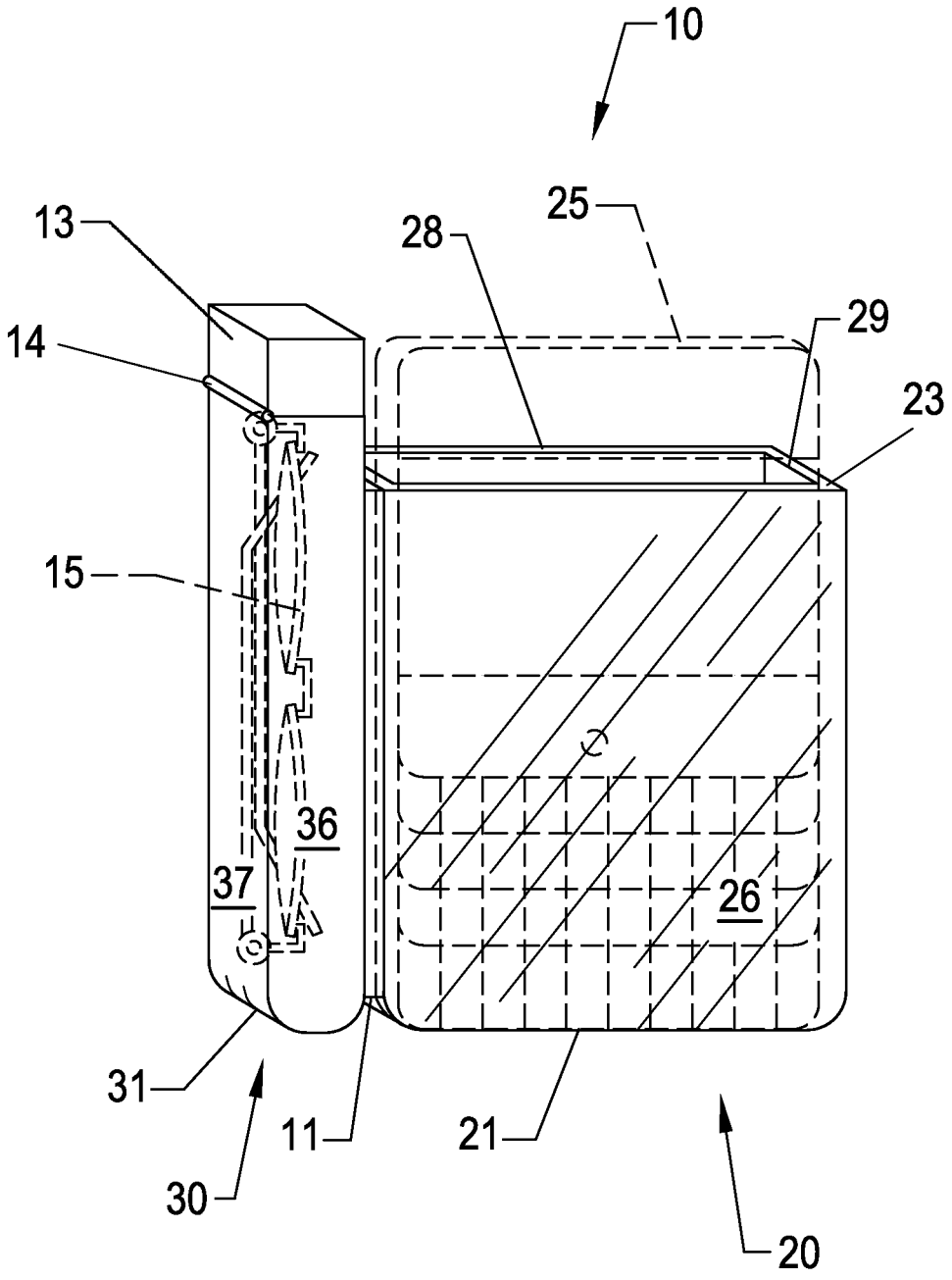
FIG. 2 is a perspective view showing a second embodiment of the combination cell phone and eyeglass case of the present invention.
Figure 3:
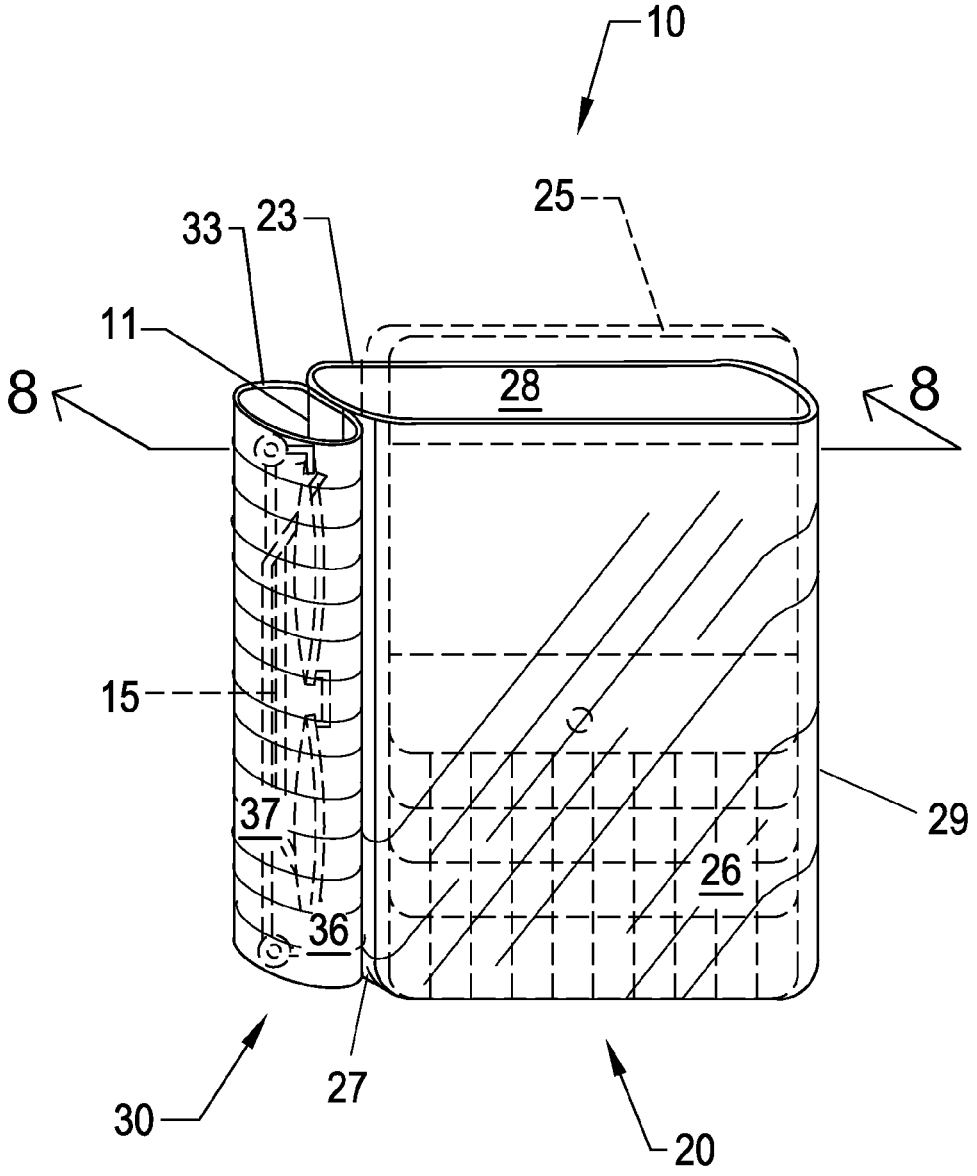
FIG. 3 is a perspective view showing a third embodiment of the combination cell phone and eyeglass case of the present invention.
Figure 4:
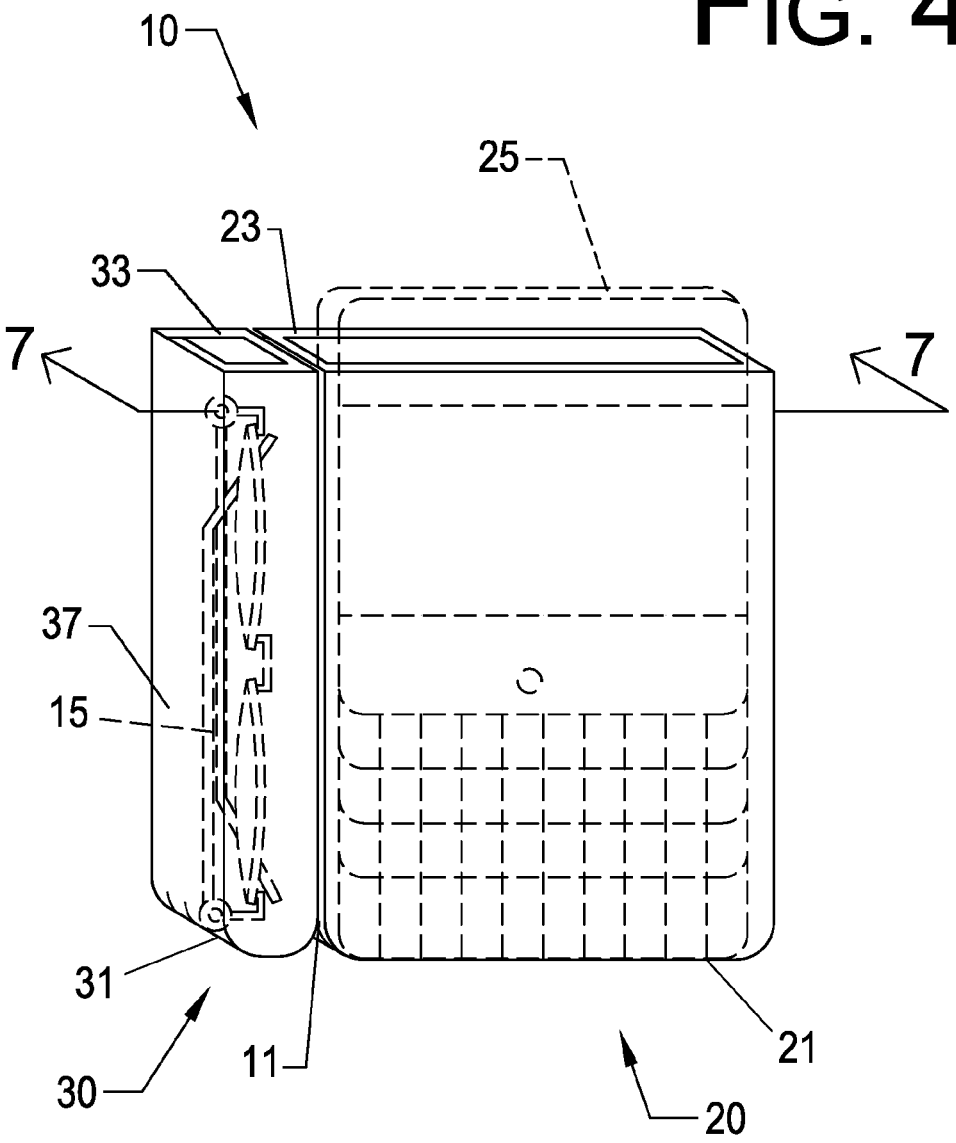
FIG. 4 is a perspective view showing a fourth embodiment of the combination cell phone and eyeglass case of the present invention.
Figure 5:
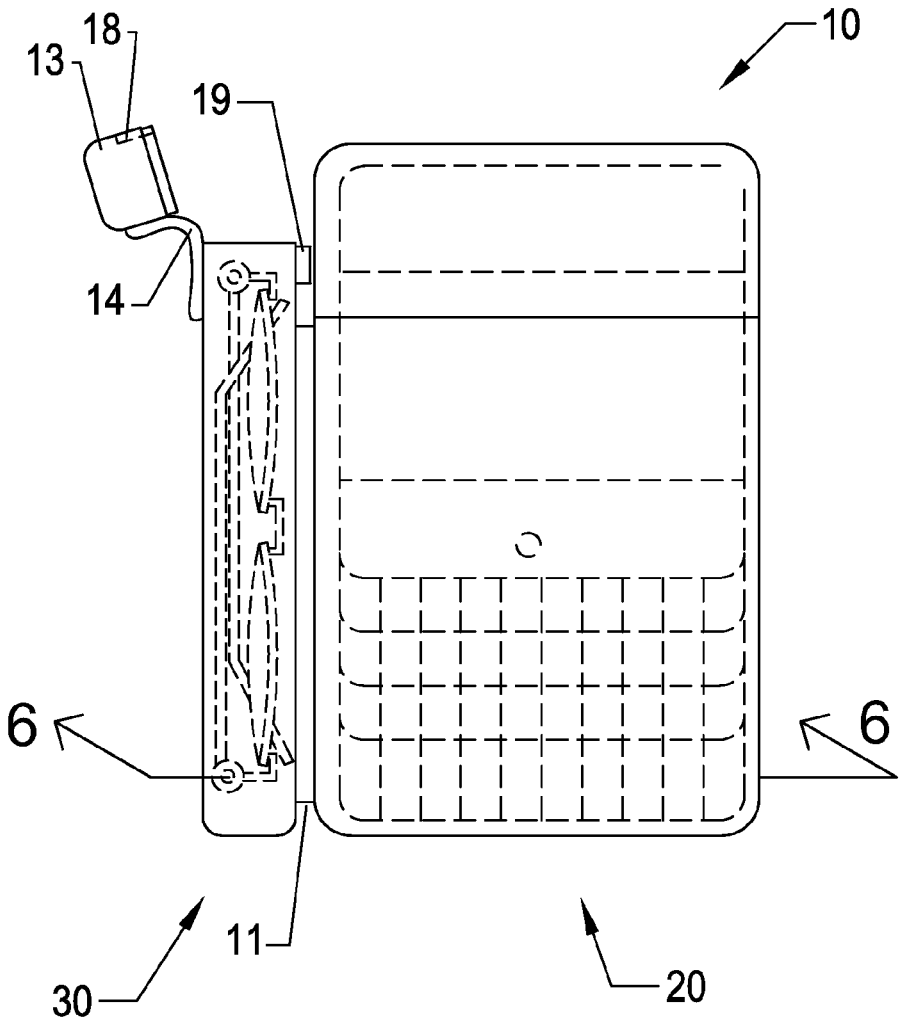
FIG. 5 is a front view showing the fifth embodiment of the combination cell phone and eyeglass case of the present invention.
Figure 6:
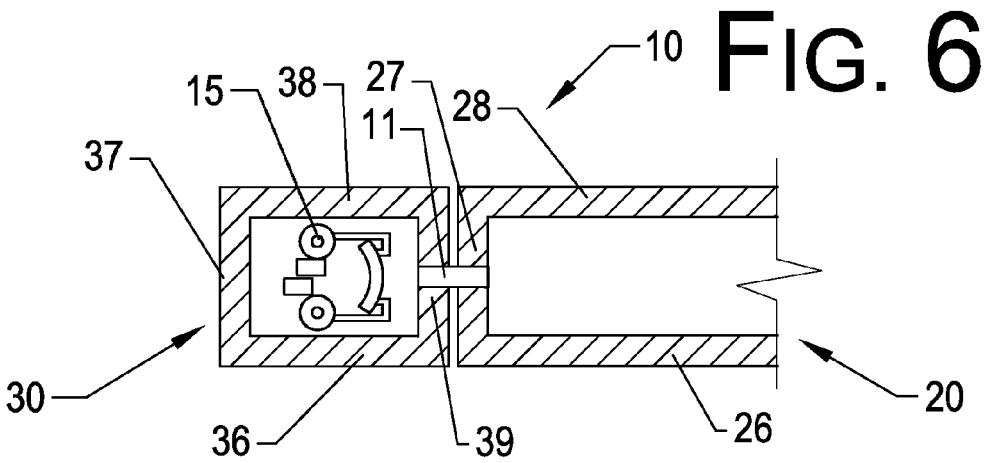
FIG. 6 is a cut view taken along the lines 6-6 of FIG. 5, showing the fifth embodiment of the combination cell phone and eyeglass case of the present invention.
Figure 7:
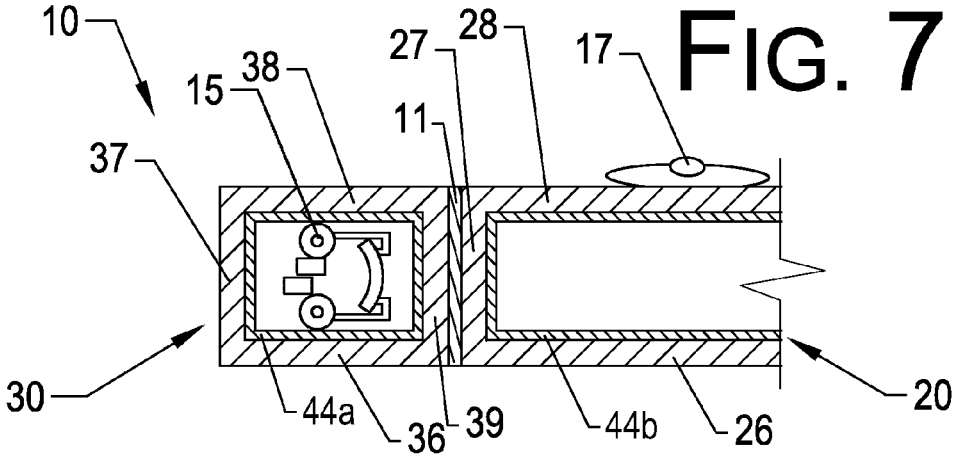
FIG. 7 is a cut view taken along the lines 7-7 of FIG. 4 illustrating an optional lining depicted with the fourth embodiment of the combination cell phone and eyeglass case of the present invention.
Figure 8:
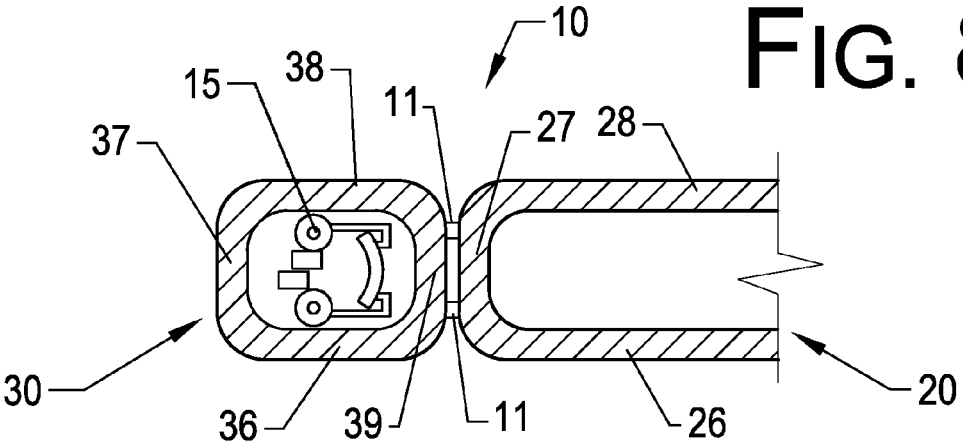
FIG. 8 is a cut view taken along the lines 8-8 of FIG. 3, showing the third embodiment of the combination cell phone and eyeglass case of the present invention.
Figure 9:
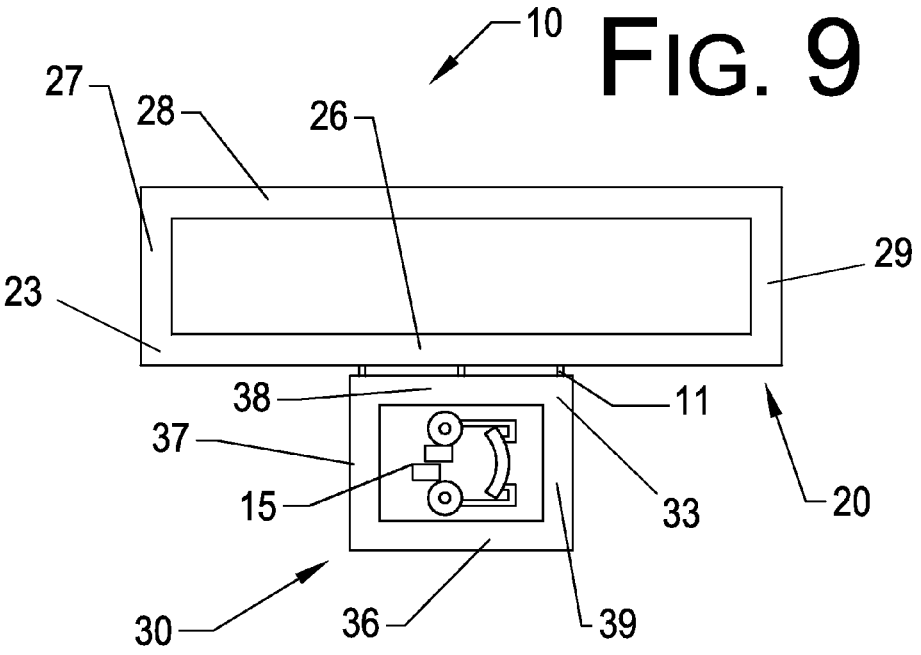
FIG. 9 is a top view showing the sixth embodiment of the combination cell phone and eyeglass case of the present invention.
Figure 10:
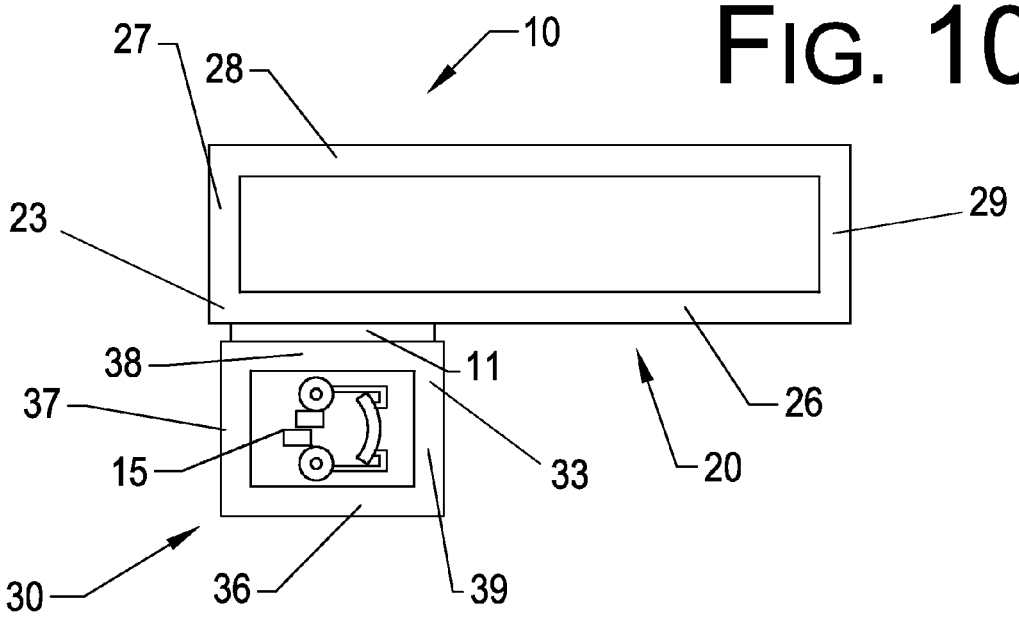
FIG. 10 is a top view showing the seventh embodiment of the combination cell phone and eyeglass case of the present invention.
Figure 11:
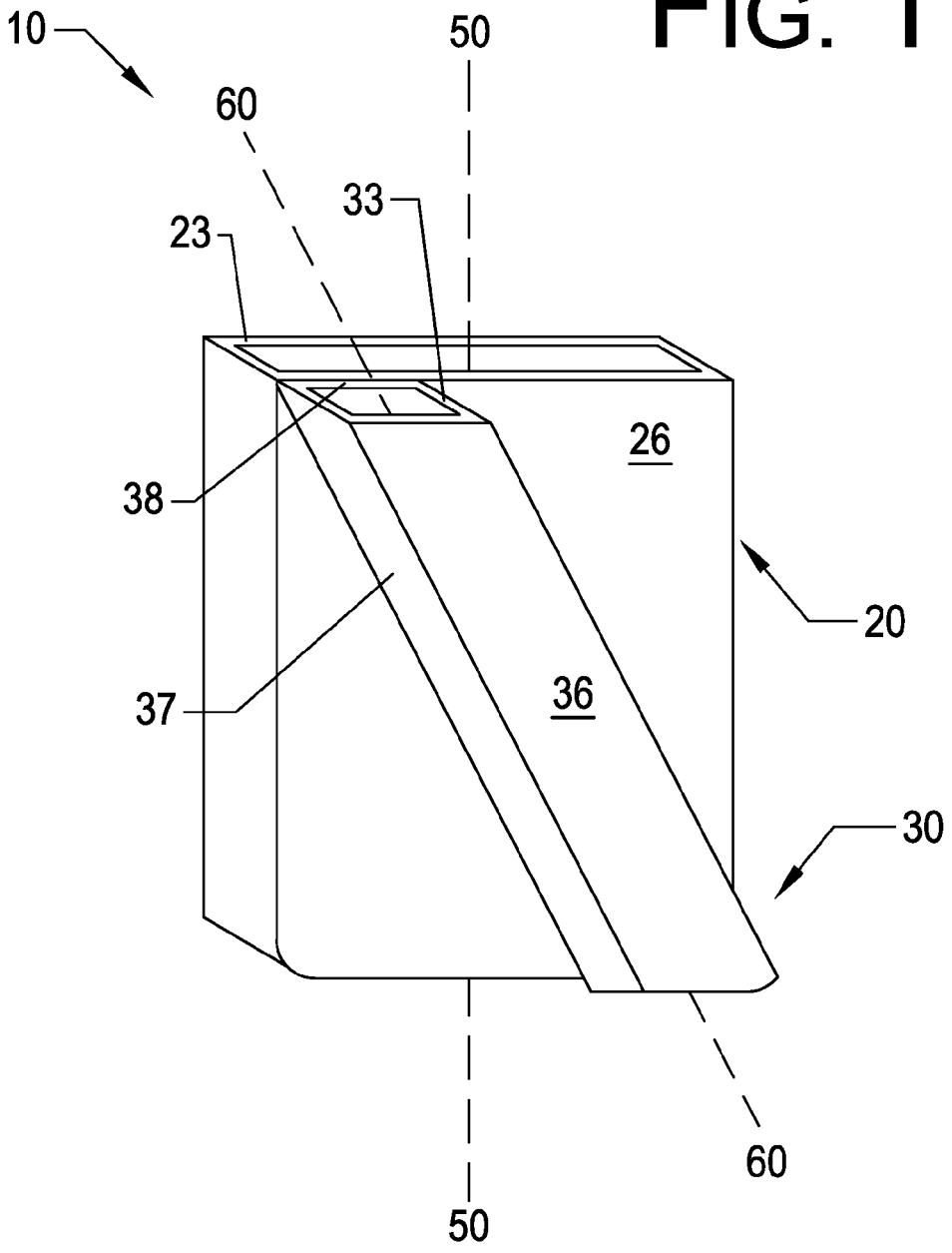
FIG. 11 is a perspective view showing the eighth embodiment of the combination cell phone and eyeglass case of the present invention.
Figure 12:
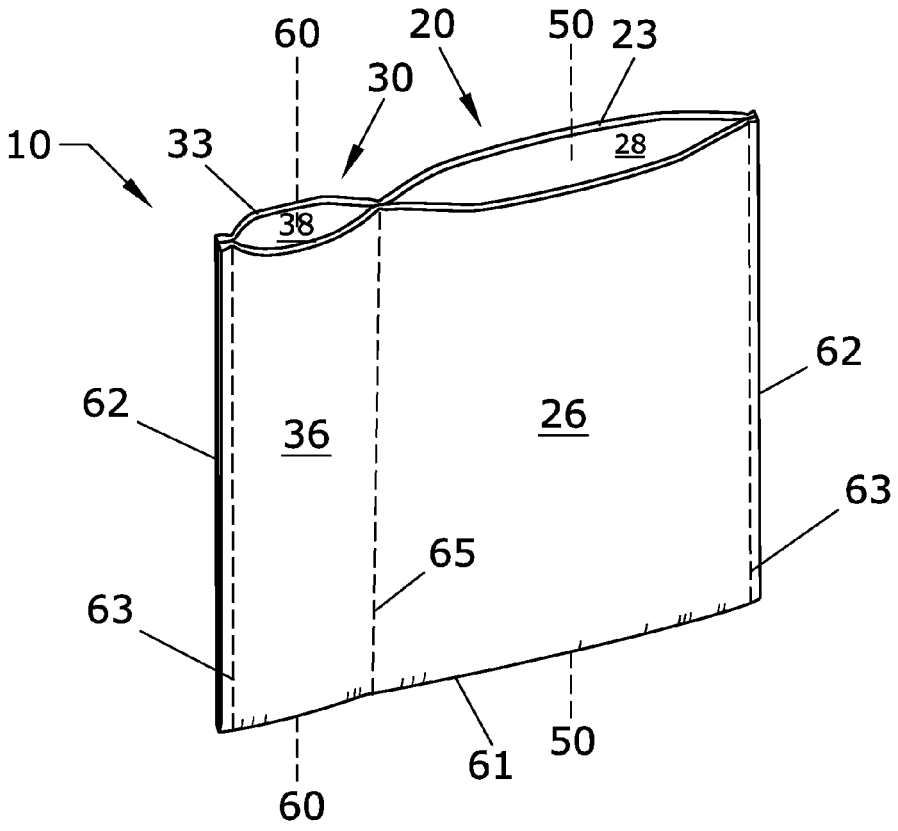
FIG. 12 is a perspective view showing the ninth embodiment of the combination cell phone and eyeglass case of the present invention.
Figure 13:
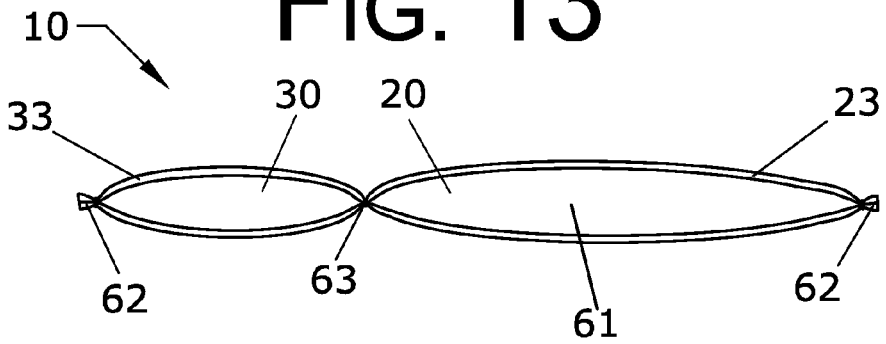
FIG. 13 is a top view showing the ninth embodiment of the combination cell phone and eyeglass case of the present invention.
Figure 32:
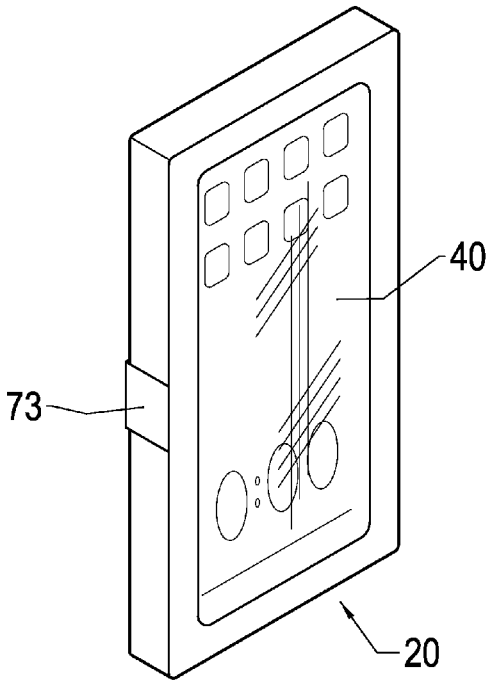
FIG. 32 is a front perspective view from the phone housing compartment side showing the twelfth embodiment of the combination cell phone and eyeglass case of the present invention.
Figure 33:
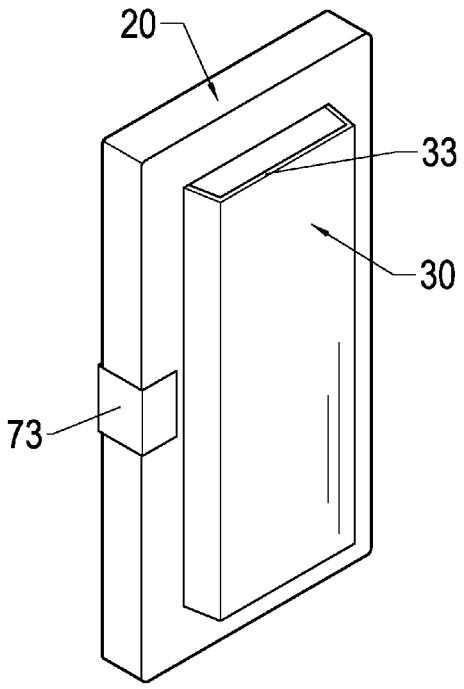
FIG. 33 is a back perspective view from the eyeglass/storage compartment side of the twelfth and thirteenth embodiment of the present invention.
Figure 34:
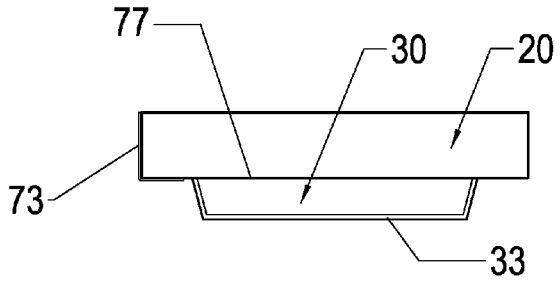
FIG. 34 is a top view of the twelfth and thirteenth embodiment of the present invention.
Figure 35:
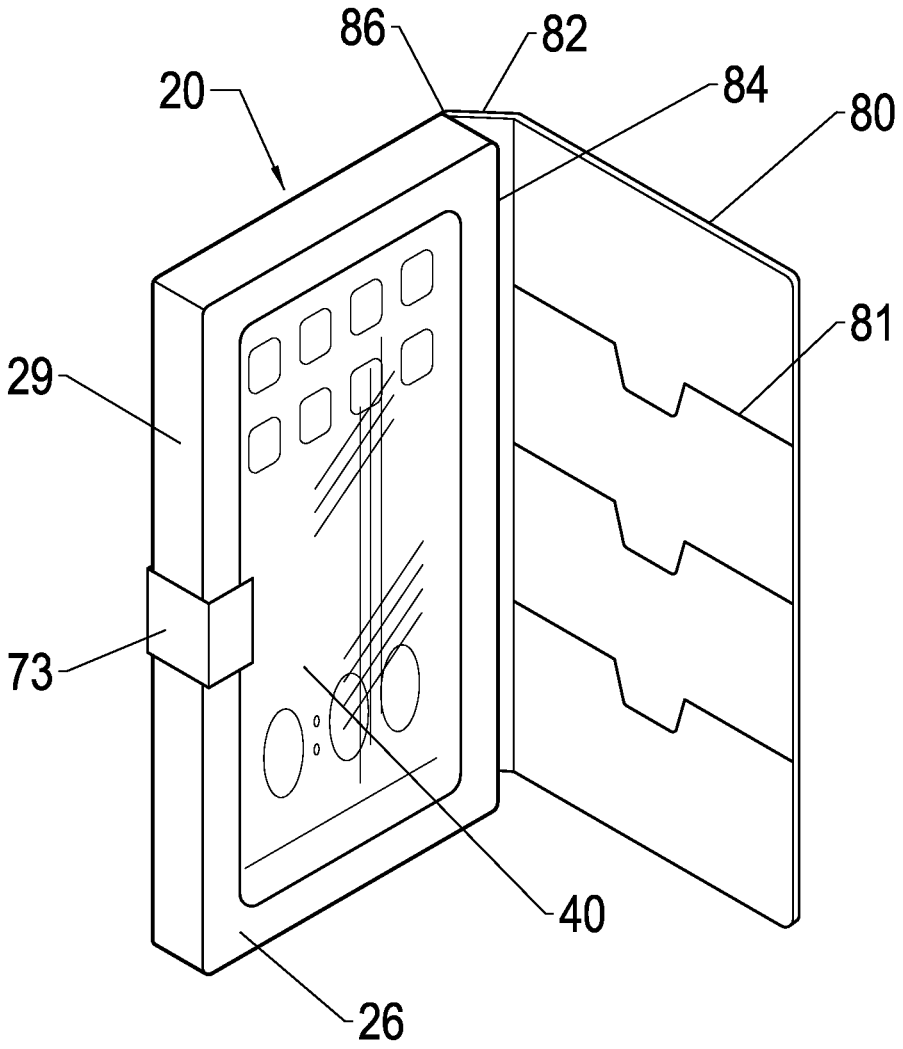
FIG. 35 is a front perspective view from the phone housing compartment side showing the thirteenth embodiment of the combination cell phone and eyeglass case of the present invention.

Thirteen exemplary embodiments are presented, a first embodiment shown in FIG. 1; a second embodiment shown in FIG. 2; a third embodiment shown in FIG. 3 and FIG. 8; a fourth embodiment shown in FIG. 4 and FIG. 7; a fifth embodiment shown in FIG. 5 and FIG. 6; a sixth embodiment shown in FIG. 9; a seventh embodiment shown in FIG. 10; an eighth embodiment shown in FIG. 11; a ninth embodiment shown in FIGS. 12, 13, 14, 15; a tenth embodiment shown in FIGS. 16-21; an eleventh embodiment shown in FIGS. 25-30; a twelfth embodiment shown in FIGS. 32-34; and a thirteenth embodiment shown in FIGS. 33-35. In the preferred tenth and eleventh embodiments, the two compartments for the phone and eyeglasses are back to back with dual spring hinges to close the compartments and with a transparent access window 40 in the phone compartment that allows the user to use and contact the front touchscreen of the phone—while the phone is still contained within the combination case 10. Also provided is a variety of inserts that allow the user to customize the combination cell phone and eyeglass case 10 for his or her particular phone (by providing removable resilient inserts 66 shown in FIGS. 23-24 to facilitate a good phone fit) and specific needs (by providing compartment inserts 67, 69 that can be installed for specific usages).

Referring now to FIG. 1, the combination cell phone and eyeglass case is illustrated in accordance with a first embodiment of the present invention. As shown, the combination case 10 of the first embodiment comprises a phone housing compartment 20 and adjacent eyeglass/storage compartment 30 that are permanently joined by a joining mechanism 11. In the first embodiment the longitudinal eyeglass/storage axis 60 (running from the center of the eyeglass/storage top opening defined by edge 33 to the center bottom of the eyeglass/storage compartment 30) is substantially parallel to the longitudinal phone housing axis 50 (running from the center of phone housing top opening defined by edge 23 to the center bottom of the phone housing compartment 20).

The phone housing compartment 20 is sized and configured to accommodate the phone 25, allowing the phone 25 to be easily inserted into, and removed from, the phone housing compartment 20. The phone housing compartment 20 also provides protection for the phone when the phone 25 is installed within the phone housing compartment 20.

The phone housing compartment 20 comprises a phone housing bottom wall 21, phone housing front wall 26, phone housing back wall 28, and two opposing phone housing side walls 27 (FIGS. 6-8), 29 (FIGS. 1-2) joined to form a compartment sized and configured to receive a cell phone. Optionally, the phone housing front wall 26 may be wholly or substantially transparent, as seen in FIG. 2, with the transparent material chosen to allow the user to perform some tasks and to use the phone to at least a limited extent while the phone is contained within the phone housing compartment 20.

The tops of the phone housing front wall 26, phone housing back wall 28, and two opposing phone housing side walls 27, 29 define a phone housing top opening edge 23 (FIG. 3) sized and configured to receive the phone into the phone housing compartment 30. In the first embodiment of FIG. 1, an upper back extension 22 is disposed above the phone housing back wall 28 and above the phone housing top opening edge 23 and extends upwardly to provide an additional measure of support to the back of the encased phone 25. Upper back extension 22 may be formed integrally with phone housing back wall 28 or may be formed separately and permanently attached.

The slim eyeglass/storage compartment 30 is sized and configured to accommodate a pair of eyeglasses 15 (such as reading glasses or prescription glasses), allowing the eyeglasses 15 to be easily inserted into, and removed from, the eyeglass/storage compartment 30. The eyeglass/storage compartment 30 provides protection to the eyeglasses 15 when the eyeglasses 15 are installed within the eyeglass/storage compartment 30.

The eyeglass/storage compartment 30 comprises an eyeglass/storage bottom wall 31, eyeglass/storage front wall 36, eyeglass/storage back wall 38, and two opposing eyeglass/storage side walls 37, 39 joined to form a compartment sized and configured to receive a pair of eyeglasses.

The tops of the eyeglass/storage front wall 36, eyeglass/storage back wall 38, and two opposing eyeglass/storage side walls 37, 39 define an eyeglass/storage top opening edge 33 sized and configured to receive the eyeglasses 15 into the eyeglass/storage compartment 30. In the first through eighth embodiments the eyeglass/storage compartment 30 and the phone housing compartment 20 are oriented in the same direction so that eyeglass/storage top opening edge 33 and the phone housing top opening edge 23 open upwardly. The eyeglass/storage top opening edge 33 and the phone housing top opening edge 23 may be of similar height (as illustrated in FIG. 3 and FIG. 4); or the eyeglass/storage compartment 30 may extend upward somewhat, with the eyeglass/storage top opening edge 33 at a higher level than the phone housing top opening edge 23 (as illustrated in FIGS. 1-2); or the eyeglass/storage top opening edge 33 may be at a lower level (not shown) than the phone housing top opening edge 23.

The eyeglass/storage compartment 30 and the phone housing compartment 20 of the first through eight embodiments are preferably formed of a molded or hardened leather to give structure to the dedicated case and to form the walls of the compartments. The methods used to mold the leather are well known in the art; they include, for example, soaking the leather to increase pliability, placing a mold within the compartment, and allowing the leather to dry, either by air drying or heated drying methods. Optionally, a frame may be provided that provides a structure onto which natural or manmade leather, synthetic plastic materials, fabrics or other commonly used casing material may be adhered.

The eyeglass/storage compartment 30 and the phone housing compartment 20 of the first through eighth embodiments are permanently joined together by a joining mechanism 11. Best seen in the cut views of FIGS. 6-8, the eyeglass/storage side wall 39 and the phone housing side wall 27 are secured by any of a variety of permanently joining mechanisms, as are known in the art. For example, the joining mechanism 11 may be a single row of sewn thread (FIG. 6), an adhesive (FIG. 7), a double row of sewn thread (FIG. 8), or the like. The thread used may be any of a wide variety of filaments, fibers, strands, string, twine, yarn, lines or the like, but is preferably a heavy duty thread for durability. Additionally, a combination of two or more joining mechanisms 11 may be utilized.

In the first embodiment of FIG. 1, the combination cell phone and eyeglass case 10 further comprises a removable eyeglass/storage cap 13 forming a top lid configured to secure the eyeglasses 15 within the eyeglass/storage compartment 30. The eyeglass/storage cap 13 is preferably slidingly engaged with the eyeglass/storage top opening edge 33. The eyeglass/storage cap 13 may be configured to be slightly smaller than the eyeglass/storage top opening edge 33 to allow convenient engagement, or vice versa (best seen in FIG. 5).

To avoid loss or misplacement, the eyeglass/storage cap 13 is preferably attached to a portion of the eyeglass/storage compartment 30. The eyeglass/storage cap 13 may be retained by any of numerous cap-retaining aids, as are known in the art. The cap-retaining aid 14 may be, for example, a hinge (as shown in FIG. 1), a tether, a strap (as shown in FIG. 5), or a section of material joining the cap 13 to the eyeglass/storage compartment.

FIG. 2 illustrates a second exemplary embodiment of the combination cell phone and eyeglass case 10 of the present invention. The second embodiment of the combination cell phone and eyeglass case 10 is functionally similar to the combination cell phone and eyeglass case 10 of the first embodiment, with the omission of the upper back extension 22 disposed above the phone housing back wall 28. Thus the second exemplary embodiment is more compact than the first embodiment.

FIG. 3 and FIG. 8 illustrate a third exemplary embodiment of the combination cell phone and eyeglass case 10 of the present invention. The third embodiment of the combination cell phone and eyeglass case 10 is functionally similar to the combination cell phone and eyeglass case 10 of the first embodiment, but illustrates a more rounded or contoured eyeglass/storage compartment 30 and a more rounded or contoured phone housing compartment 20. Additionally, the third embodiment illustrates the omission of the upper back extension 22 and the omission of the eyeglass/storage cap 13. The very streamlined third embodiment is configured with tight-fitting compartments 20, 30 for the phone and eyeglasses, respectively. As seen in FIG. 8, the third embodiment illustrates a joining mechanism 11 comprising two rows of sewn thread providing a more rigid attachment with less flexibility between the eyeglass/storage compartment 30 and the phone housing compartment 20 than with a single row of sewn thread, as in FIG. 6.

FIG. 4 and FIG. 7 illustrate a fourth exemplary embodiment of the combination cell phone and eyeglass case 10 of the present invention. The fourth embodiment of the combination cell phone and eyeglass case 10 is functionally similar to the combination cell phone and eyeglass case 10 of the first embodiment, but illustrates the omission of the upper back extension 22, the omission of the eyeglass/storage cap 13, the addition of lining 44*a* and 44*b* (FIG. 7), the addition of an optional case attachment 17 (FIG. 7), and the joining mechanism 11 embodied as adhesive.

The case attachment 17, such as a belt loop, a swivel belt clip, or a wrist loop or strap, is either permanently attached to the back of the combination cell phone and eyeglass case or removably attachable to the back of the combination cell phone and eyeglass case 10. The case attachment 17 allows the combination cell phone and eyeglass case 10 to be conveniently attached to another article, such as, for example, a belt, purse edge, keychain or user's wrist. Thus the optional case attachment 17 may allow the user to locate the combination dedicated case 10 in a convenient, easily retrievable position.

An optional lining 44 (shown as 44*a* and 44*b*) may be provided in the interior of either or both of the phone housing compartment 20 and/or the eyeglass/storage compartment 30. The lining 44 may be used in any of the embodiments of the invention. The lining 44*a* of the eyeglass/storage compartment 30 will protect the eyeglass lenses from scratching. The lining 44*b* of the phone housing compartment 20 will protect the phone screen from damage. Lining 44 may be any soft, scratch-free, natural or manmade fabric or material (such as, for example, flannel, velour, brushed cotton, flocking, knit fabric or the like) or may be a soft, anti-scratch spray-on type lining. The lining 44 may coordinate or contrast with the outside materials of the combination dedicated case 10, with the selection based on aesthetic and marketability considerations.

FIG. 5 and FIG. 6 illustrate a fifth exemplary embodiment of the combination cell phone and eyeglass case 10 of the present invention. The fifth embodiment of the combination cell phone and eyeglass case 10 is functionally similar to the combination cell phone and eyeglass case 10 of the first embodiment but illustrates an optional cap fastening mechanism 18, 19 and the cap-retaining aid 14 embodied in a strap. The cap fastening mechanism 18, 19 may be any latch or fastening mechanism, as is known in the art. The cap fastening mechanism 18, 19 may be a magnetic closure, corresponding snaps, a quick release latch, complementary hook and loop fasteners or the like. FIG. 6 illustrates joining mechanism 11 as a single row of sewn thread.

FIG. 9 illustrates a sixth exemplary embodiment of the combination cell phone and eyeglass case 10 of the present invention. The sixth embodiment of the combination cell phone and eyeglass case 10 is functionally similar to the combination cell phone and eyeglass case 10 of the first embodiment but illustrates an alternate positioning of the two compartments 20, 30. As in the first five embodiments the eyeglass/storage top opening edge 33 and the phone housing top opening edge 23 are oriented in a similar direction; also, the phone housing axis 50 is generally parallel to the eyeglass/storage axis 60. However, the eyeglass/storage compartment 30 is positioned in a generally central front area of the phone housing compartment 20, with the eyeglass/storage back wall 38 joined in a central area of the phone housing front wall 26.

FIG. 10 illustrates a seventh exemplary embodiment of the combination cell phone and eyeglass case 10 of the present invention. The seventh embodiment of the combination cell phone and eyeglass case 10 is functionally similar to the combination cell phone and eyeglass case 10 of the first embodiment, but illustrates a second alternate positioning of the two compartments 20, 30. As in the first six embodiments the eyeglass/storage top opening edge 33 and the phone housing top opening edge 23 are oriented in a similar direction; also, the phone housing axis 50 is generally parallel to the eyeglass/storage axis 60. However, the eyeglass/storage compartment 30 is positioned off-center of the phone housing compartment 20, with the eyeglass/storage back wall 38 joined to a side area of the phone housing front wall 26.

FIG. 11 illustrates an eighth exemplary embodiment of the combination cell phone and eyeglass case 10 of the present invention. The eighth embodiment of the combination cell phone and eyeglass case 10 is functionally similar to the combination cell phone and eyeglass case 10 of the first embodiment but illustrates a third exemplary alternate positioning of the two compartments 20, 30 and illustrates that longitudinal phone housing axis 50 and longitudinal eyeglass/storage axis 60 need not be parallel. As in the first seven embodiments the eyeglass/storage top opening 33 and the phone housing top opening edge 23 are oriented in a similar direction, but the phone housing axis 50 is generally diagonal to the eyeglass/storage axis 60. The eyeglass/storage back wall 38 is joined diagonally to the phone housing front wall 26. Other placements and positions of the eyeglass/storage compartment 30 in relation to the phone housing compartment 20 are also within the scope of the invention. Other exemplary placements include the following: reverse positioning (such as the eyeglass/storage compartment 30 attached in a generally central back area of the phone housing compartment 20, not shown); bottom positioning (such as the eyeglass/storage compartment 30 permanently joined to the bottom wall 21 of the phone housing compartment 20 with the phone housing axis 50 and the eyeglass/storage axis 60 substantially perpendicular, not shown); and various positions in which the eyeglass/storage top opening 33 and the phone housing top opening edge 23 are not oriented in the same direction (not shown).

FIGS. 12 to 15 illustrate the ninth exemplary embodiment of the combination cell phone and eyeglass case 10 of the present invention. The eyeglass/storage top opening edge 33 and the phone housing top opening edge 23 are oriented in the same direction; the longitudinal phone housing axis 50 is parallel to the longitudinal eyeglass/storage axis 60. The ninth embodiment of the combination cell phone and eyeglass case 10 demonstrates a simplified structure and means of construction.

In contrast to the first through eighth embodiments, the phone housing compartment 20 and the eyeglass/storage compartment 30 of the ninth embodiment are formed of a single sheet of flexible material. The single sheet of flexible material is preferably formed of one piece, but may optionally be formed of multiple pieces joined together (such as patchwork leather or fabric). The single sheet is folded upon itself upon a fold line 61 extending across a mid-section of the flexible sheet. The fold line 61 bisects the rectangular single sheet into two substantially equal halves, forming the front halves and the opposing rear halves of the compartments. Preferably the flexible material used is natural leather or manmade leather (often referred to as "leatherette"), but the material may optionally be synthetic plastic material (such as polyvinyl chloride, polyurethane, or the like) or a thick fabric (such as canvas, corduroy, velvet, denim, or the like).

Figure 14:
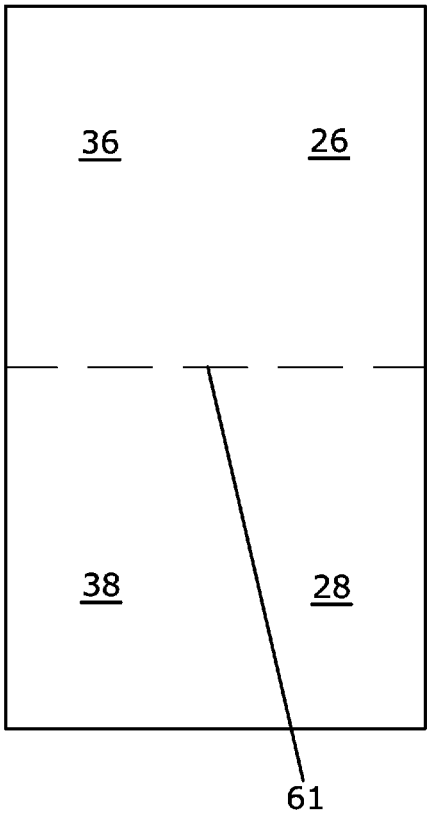
FIG. 14 is a front view showing the material of the unconstructed ninth embodiment of the combination cell phone and eyeglass case of the present invention.
Figure 15:
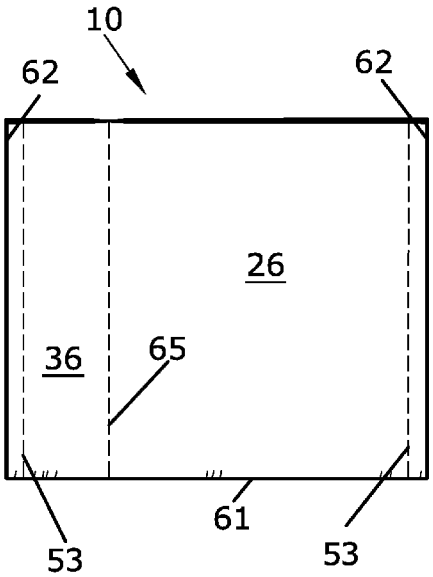
FIG. 15 is a front view showing the ninth embodiment of the combination cell phone and eyeglass case of the present invention.

FIG. 14 illustrates the single rectangular sheet of material from which the combination cell phone and eyeglass case 10 is formed. (Though shown for clarity of understanding as cut to size before stitching, in manufacturing multiple cases 10 from a larger piece of material, some or all of the stitching may be performed before cutting.) To construct the case, the material is folded substantially in half along fold area 61. The folded material is then stitched with stitching 53 along the opposing outer edges 62 and stitched with stitching 65 along an interior compartment dividing line parallel to the outer edges 62. Stitching 65 creates two compartments, the phone housing compartment 20 and the eyeglass/storage compartment 30. The two compartments 20, 30 created are of unequal width proportions, as the compartment 20 for receiving the wider phone is broader than the compartment 30 for receiving the narrower eyeglasses. Therefore, the interior compartment dividing line of stitching 65 may be offset from one of the opposing ends 62 approximately fifteen to thirty percent of the distance between the opposing ends 62. The stitching 53 and the stitching 65 join the back half of the flexible material to the front half of the flexible material with stitches of thread. The thread used may be any of a wide variety of filaments, fibers, strands, string, twine, yarn, lines or the like, but is preferably a nylon thread having a breaking point of 20-30 pounds.

Figure 17:
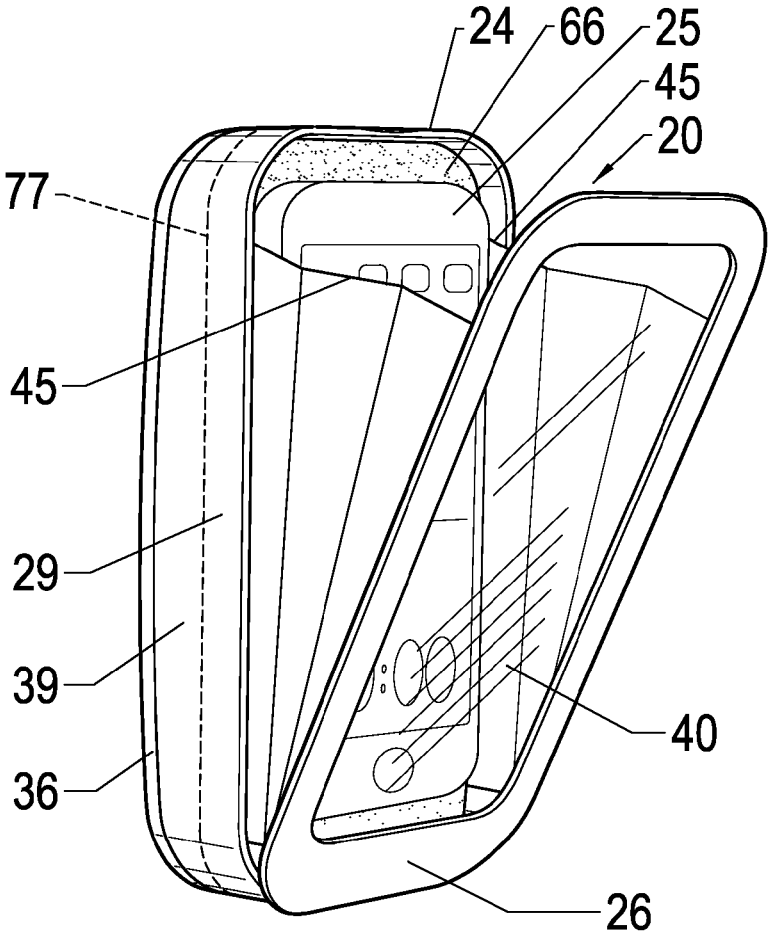
FIG. 17 is a front perspective view from the phone housing compartment side showing the tenth embodiment of the present invention.
Figure 18:
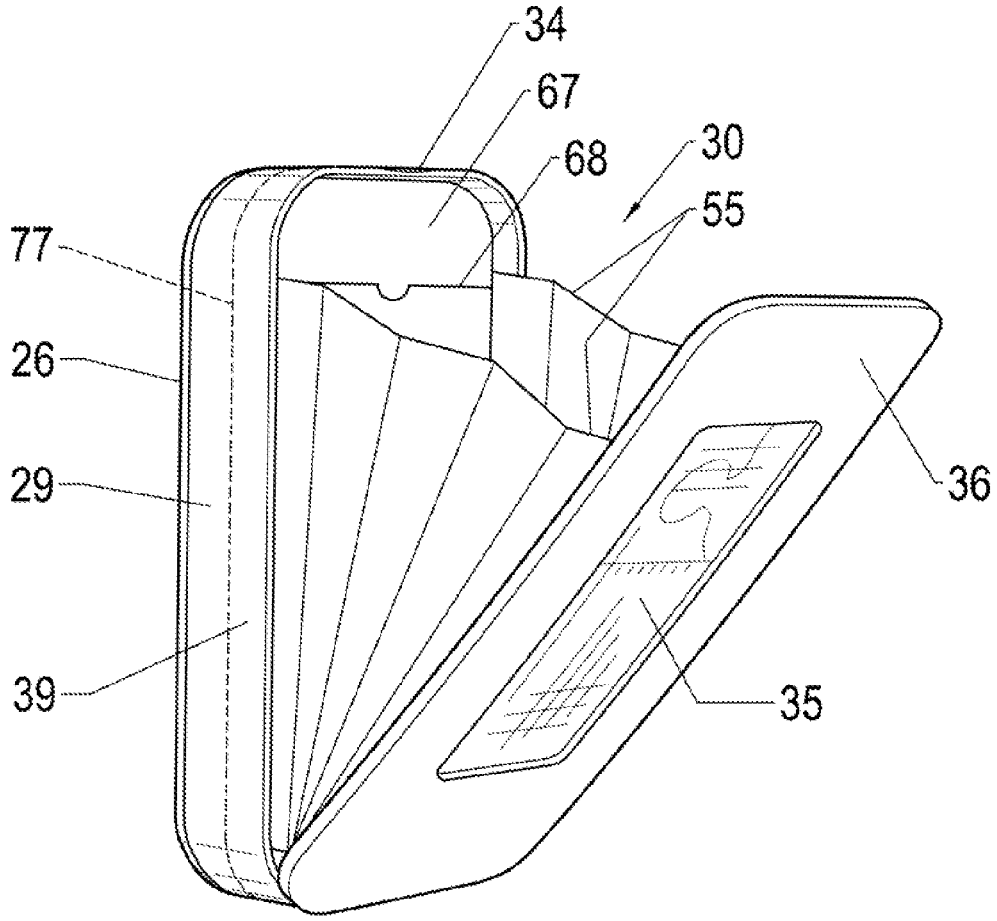
FIG. 18 is a back perspective view from the eyeglass/storage compartment side showing the tenth embodiment of the present invention.
Figure 19:
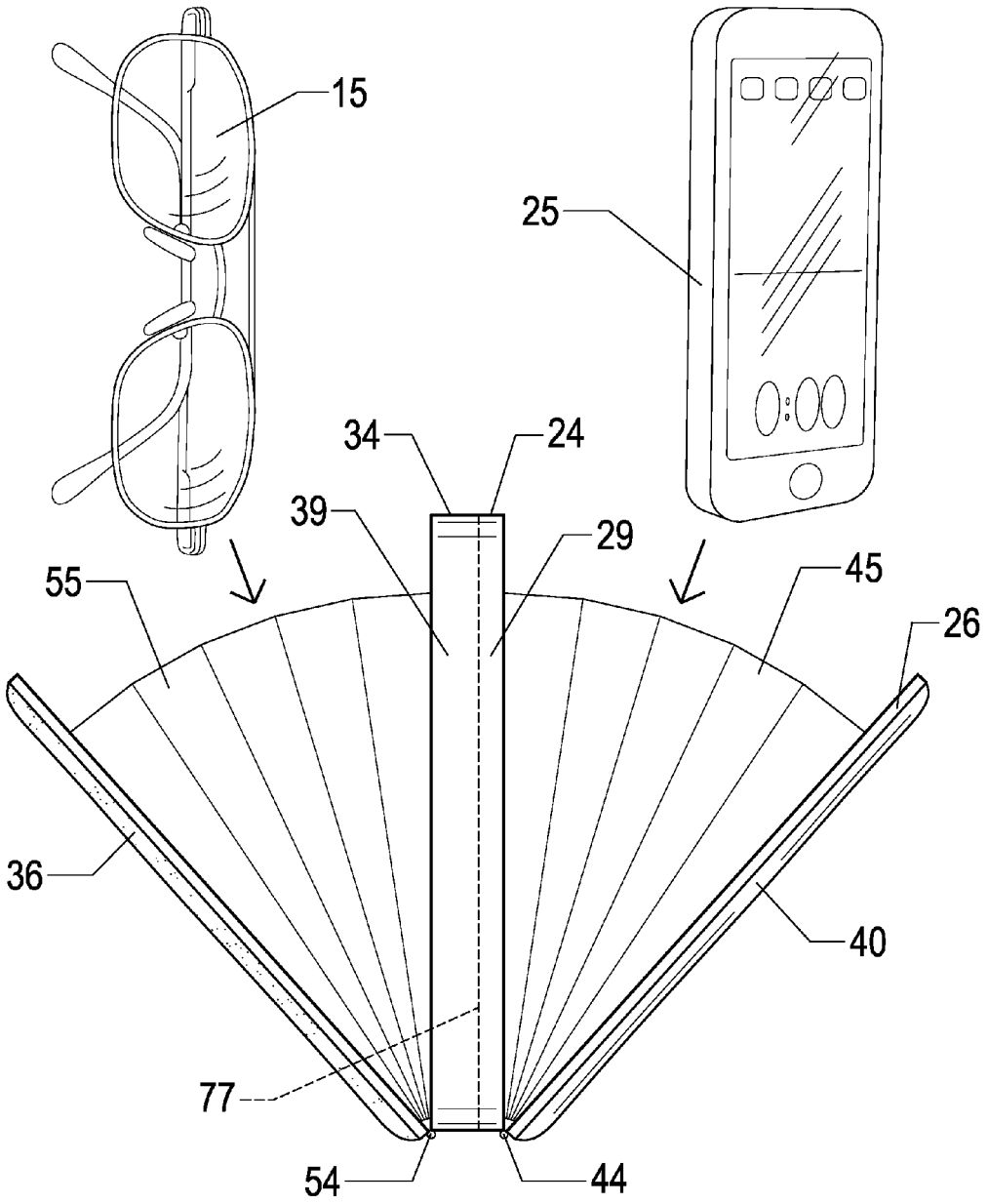
FIG. 19 is a side view showing the tenth embodiment of the present invention.

In this ninth embodiment, the eyeglass/storage compartment 30 and phone housing compartment 20 are closed tubular pouches separated only by stitching 65. By rotating the case 10 horizontally 180° (side to side), the eyeglass/storage compartment 30 may be positioned either on the right or left of phone housing compartment 20. A front may be designated by designs, patterns or logos. Optionally, the front may be designated by including a transparent window 40, as seen in FIG. 17, which will allow the user to view and interact with the enclosed phone.

If the leather material is used, no hem or seam is required along the eyeglass/storage top opening edge 33 or the phone housing top opening edge 23, however a finished edge may be included, if aesthetically preferable or if required for durability. If the top edges 23, 33 are finished with a hem, the hem may be turned to the inside or to the outside of the compartments 20, 30. The material used to form the case 10 is generally sufficiently flexible to allow both the phone and the eyeglasses to be inserted into their respective compartments 20, 30. However, if greater expansion is desired (such as when a somewhat heavier weight leather is chosen for usage), leather molding techniques, as are known in the art, can be used to slightly expand the deeper recesses of one or both compartments 20, 30. The combination cell phone and eyeglass case 10 of the ninth embodiment is very economical to manufacture due to the ease of construction and the minimal materials required. Additionally, the sleek, compact form factor facilitates storage of the case 10 within a crowded purse or briefcase.

The preferred tenth and eleventh embodiments of the combination cell phone and eyeglass case 10 are illustrated in FIGS. 16-24, 31 and FIGS. 23-32, respectively. Both the tenth and eleventh embodiments provide a dual-hinged case 10; a transparent access window 40 (providing viewing of and contact with the phone's front touchscreen); a set of phone housing side bellows 45; a set of eyeglass/storage side bellows 55; and inserts 66, 67, 69 (FIGS. 22-24, 31) usable in both embodiments. In the tenth and eleventh embodiment, both the phone housing compartment 20 and the eyeglass/storage compartment 30 are formed with an inward portion hingedly connected to an outward portion, preferably sharing a common back wall 77 or, optionally, each having a separate back wall 28, 38 (FIG. 21). In both embodiments the openings of the phone housing compartment 20 and of the eyeglass/storage compartment 30 are oriented in the same direction. When the combination cell phone and eyeglass case 10 is in the closed position, the longitudinal phone housing axis 50 is parallel to the longitudinal eyeglass/storage axis 60.

In the tenth embodiment, the phone housing compartment 20 comprises a phone housing bottom wall 21 (FIG. 20), two opposing phone housing side walls 29, a set of phone housing bellows 45, a phone housing front wall 26, and a back wall (either a shared back wall 77 or phone housing back wall 28). A bottom phone housing hinge 44 joins the phone housing bottom wall 21 to the phone housing front wall 26. The phone housing compartment 20 may have an open top, as shown in FIGS. 1-5, but preferable has a closed top and includes a phone housing top wall 24.

The phone housing front wall 26 forms the forward or outward most portion of the phone housing compartment 20. The phone housing front wall 26 may be generally planar as in FIG. 17, may be flat but curved as in FIG. 16, or may have a rounded portion extending outwardly from the inward-facing front wall back edge 46 (FIG. 21) to increase the depth of the front wall 26 to accommodate a greater portion of the depth of the phone to be contained. The forward portion of phone housing front wall 26 preferably includes an optional centrally disposed transparent access window 40. The transparent access window 40 may extend over 50% to 100% of the front surface area of phone housing front wall 26. Preferably the phone housing front wall 26 may provide a narrow frame that supports the inner transparent access window 40 portion, with the transparent access window 40 occupying 75% to 95% of the front surface area. Optionally, the window 40 may be configured with openings situated in advantageous locations to allow the microphone and speakers of the phone to be most effective. The outer portion of the phone housing front wall 26 may curve slightly to accommodate the width of a received phone 25, ending in an inward-facing front wall back edge 46 (FIG. 21) that extends across the top, along a first side, across the bottom, and along a second side of the phone housing front wall 26.

The inside back of the phone housing compartment 20 may be a shared wall 77 as seen in FIGS. 16-19. Common wall 77 comprises a phone-facing side/surface and an eyeglass-facing side/surface. When the phone housing compartment 20 and the eyeglass/storage compartment 30 share a single common wall 77, the phone-facing side forms the back wall of phone housing compartment 20 and the eyeglass-facing side forms the back wall of the eyeglass/storage compartment 30. In another aspect the phone housing back wall 28 may lie adjacent to the eyeglass/storage back wall 38 forming a double wall, as seen in FIG. 21.

The shared common back wall 77 or phone housing back wall 28 is fixedly attached to the phone housing top wall 24, to phone housing bottom wall 21, and to opposing phone housing side walls 29 to form the back, top, bottom and sides of the rearward portion of the phone housing compartment 20. Optionally, this rearward portion of the phone housing compartment 20 may receive a resilient insert 66 (FIGS. 23-24) discussed further below. Both opposing phone housing side walls 29 have a forward or outward-facing edge 49. The phone housing top wall 24 has a forward or outward-facing edge, and the phone housing bottom wall 21 has a forward or outward-facing edge.

Figure 16:
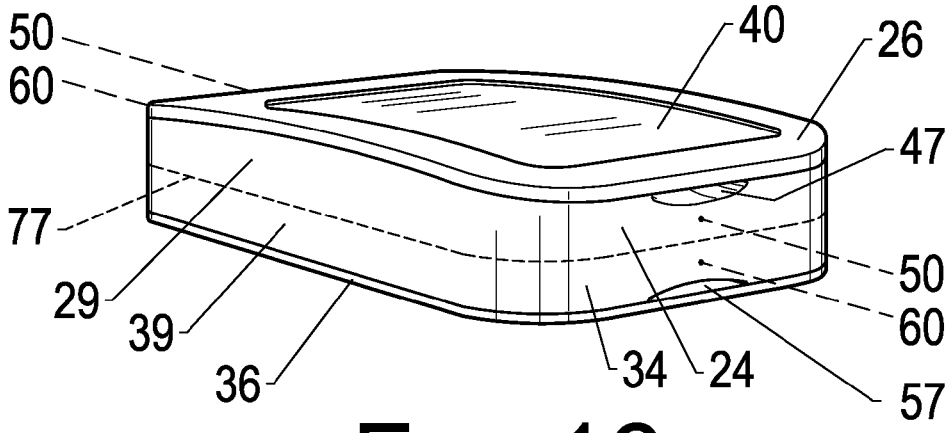
FIG. 16 is a top perspective view showing a preferred tenth embodiment of the combination cell phone and eyeglass case of the present invention.
Figure 20:
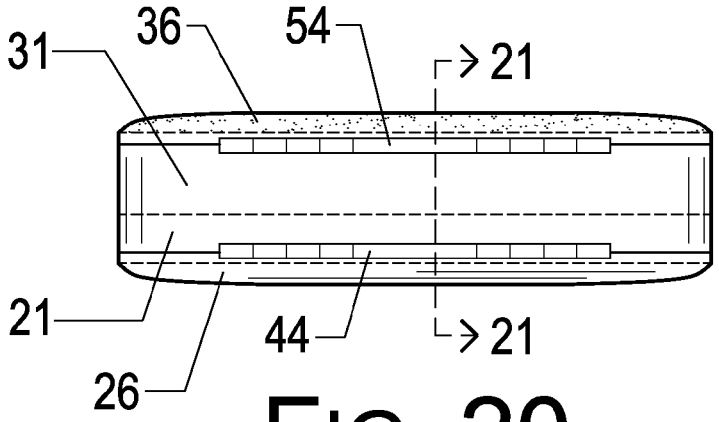
FIG. 20 is a bottom view showing the tenth embodiment of the present invention.
Figure 21:
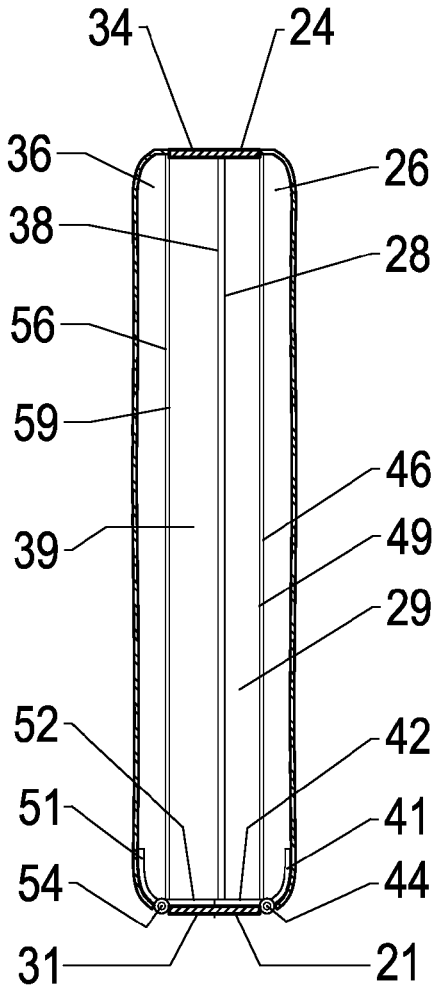
FIG. 21 is a side view showing the tenth embodiment of the present invention.

When the phone housing compartment 20 is closed, as in FIGS. 16, 20-21, the phone housing inward-facing back edge 46 is adjacent to the outward-facing edges of the side walls 29, bottom wall 21 and top wall 24. As can be seen while looking at FIG. 16 and FIG. 17 together, the lower portion of phone housing front wall 26 is rotatably attached by the phone housing hinge 44 (FIGS. 20-21) to the lower portion of phone housing bottom wall 21. The phone housing front wall 26 is movable from a closed position (see FIG. 16) wherein the phone housing compartment 20 is closed with the phone housing bellows 45 folded and shut inside to an open position (see FIG. 17) wherein the phone housing bellows 45 are extended and the phone housing compartment 20 is opened to allow access for storage of the phone 25. The spring action of the hinge 44 is preferably robust enough to maintain the phone housing compartment 20 in the closed position until manually opened.

Optionally, a phone housing grip 47 (FIG. 16) disposed at phone housing top wall 24 may be included. The phone housing grip 47 may be a finger-receiving indentation within the phone housing top wall 24 that allows the user to more conveniently grasp the top edge of the phone housing front wall 26 to manually rotate it (via hinge 44) away from the phone housing top wall 24 to open the phone housing compartment 20. Optionally, the phone housing grip 47 may be of a latch type to secure the phone housing front wall 26 to the phone housing top wall 24. Various types of latches as are known in the art may be used, such as a magnetic latch or frictionally-engageable latch.

Figure 29:
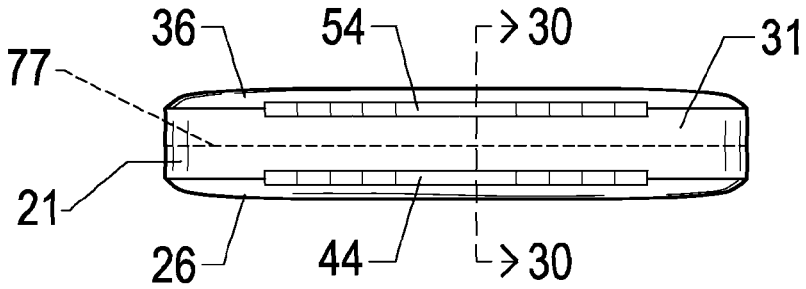
FIG. 29 is a bottom view showing the eleventh embodiment of the present invention.
Figure 30:
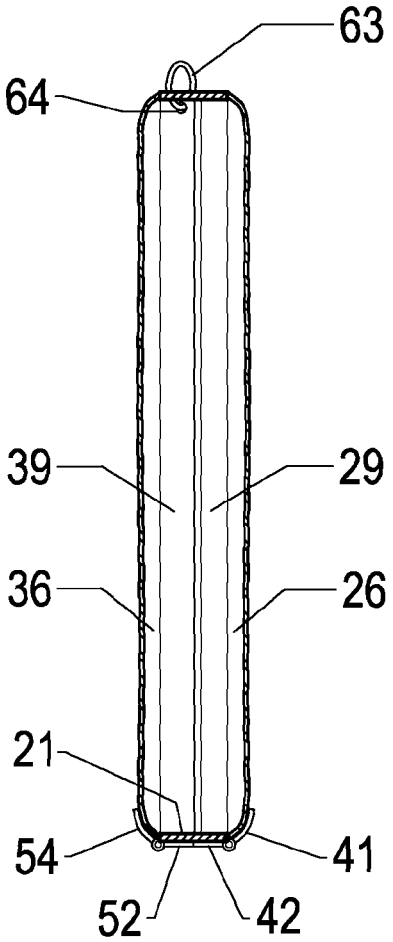
FIG. 30 is a side view showing the eleventh embodiment of the present invention.

The phone housing hinge 44 may be any conventional hinge, as is known in the art, but is shown in FIGS. 20-21, 29-30 as a piano hinge or butt hinge with multiple central knuckles joining a front and back leaf (phone housing front wall hinge leaf 41 and phone housing bottom wall hinge leaf 42, respectively). The bottom wall hinge leaf 42 is positioned in a general horizontal configuration along bottom wall 21, as seen in FIGS. 21, 29. The phone housing front wall hinge leaf 41 is preferably curved to follow the contour of phone housing front wall 26, a construction that allows maximum space to be available within the interior front portion of the phone housing compartment 20. The hinge leaves 41, 42 may be fixedly attached to an outward (FIG. 29) or inward (FIG. 21) portion of front wall 26 and to an outward (FIG. 29) or inward (FIG. 21) portion of bottom wall 21.

The two opposing phone housing bellows 45 each extend from the opposing first and second phone housing side wall outward-facing edges 49 to the opposing first and second phone housing front wall inward-facing back edges 46, respectively. The phone housing bellows 45 have a forward and rearward portion which are preferably fixedly attached to the inner surface of the side wall 29 and of the front wall 26, or the side wall 29 and/or the front wall 26 may be formed of a double material with the forward and rearward portions of the bellows 45 fixedly attached between the materials. As seen in FIG. 17, the bellows 45 may extend from at or near the bottom of side wall 29 and front wall 26 upward from 50% to 95% of the distance to the top of side wall 29 and front wall 26. The bellows may be formed of a natural or manmade fabric, a polymeric material or other sheet-like material. The eyeglass/storage bellows 55 are similar in structure and function, but disposed on the opposite side of the case 10. Each of the bellows 45, 55 may be pleated to fold upon itself when the phone housing compartment 20 is closed, or, optionally each of the bellows 45, 55 may be formed of a material that stretches to allow the exterior facing (front walls 26, 36) of each compartment 20, 30 to be rotated away from the back of the compartment 20, 30 and then retracts when the spring action of the hinge 54 or hinge 44 closes the compartment. The combination of the spring action of hinge 44 or hinge 54 with the bellows 45, 55 advantageously provide convenient access while providing security against items inadvertently falling out of the sides of the compartments 20, 30.

The transparent access window 40 is formed of a single layer or multi-layer material that allows viewing of the display of the phone 25. Preferably the material forming window 40 also allows transmission of touch from the outer surface of the window 40 to be passed through to the outer surface of the touchscreen of phone 25. The material used preferably has anti-scratch and anti-glare properties, along with good light transmission. The transparent access window 40 may be formed of polyethylene terephthalate (PET), polyurethane, polyvinylchloride (PVC), polypropylene or other soft or more rigid plastics. For example, the window 40 may be formed of PET with an anti-glare and/or anti-scratch layer.

Figure 23:
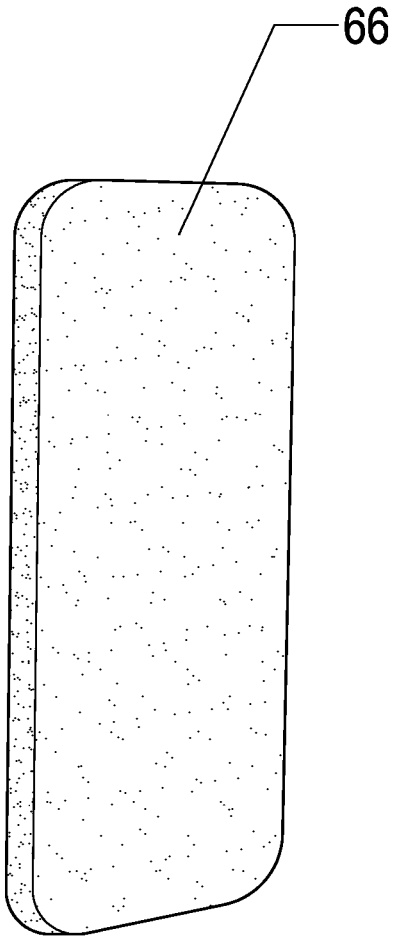
FIG. 23 is a front perspective view of a thinner resilient insert usable in either the phone housing compartment 20 or eyeglass/storage compartment 30 of the tenth and eleventh embodiments of the present invention.
Figure 24:
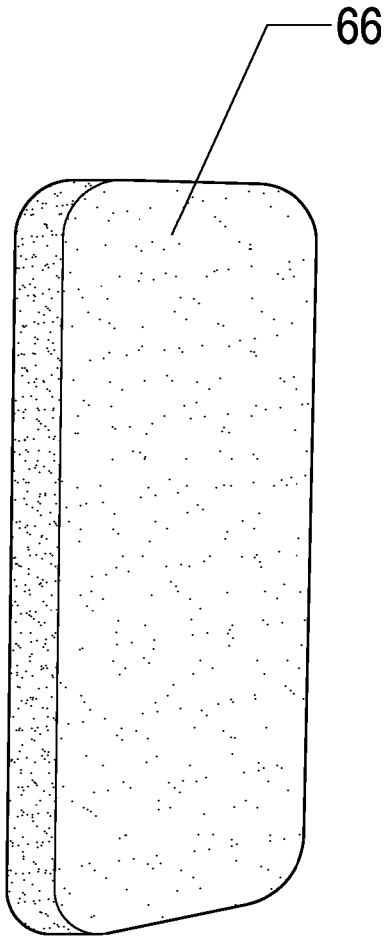
FIG. 24 is a front perspective view of a thicker resilient insert usable in either the phone housing compartment 20 or eyeglass/storage compartment 30 of the tenth and eleventh embodiments of the present invention.
Figure 25:
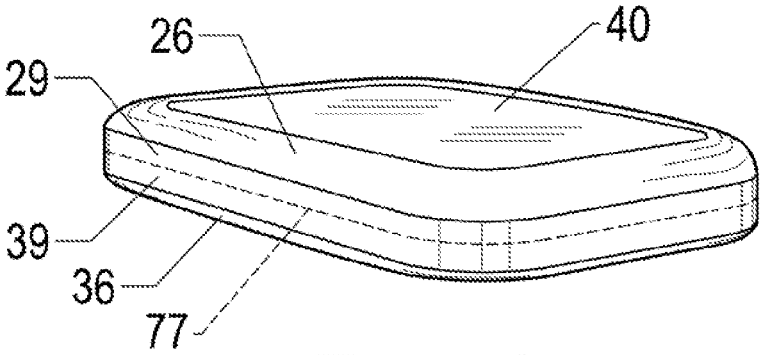
FIG. 25 is a top perspective view showing the eleventh embodiment of the combination cell phone and eyeglass case of the present invention.
Figure 26:
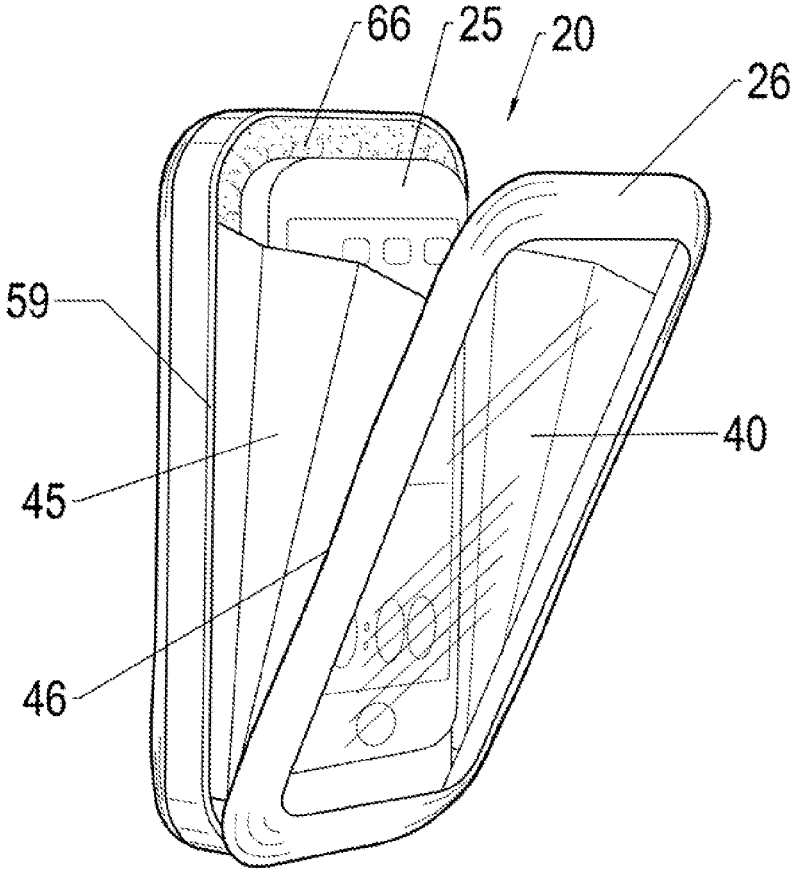
FIG. 26 is a front perspective view from the phone housing compartment side showing the eleventh embodiment of the present invention.
Figure 27:
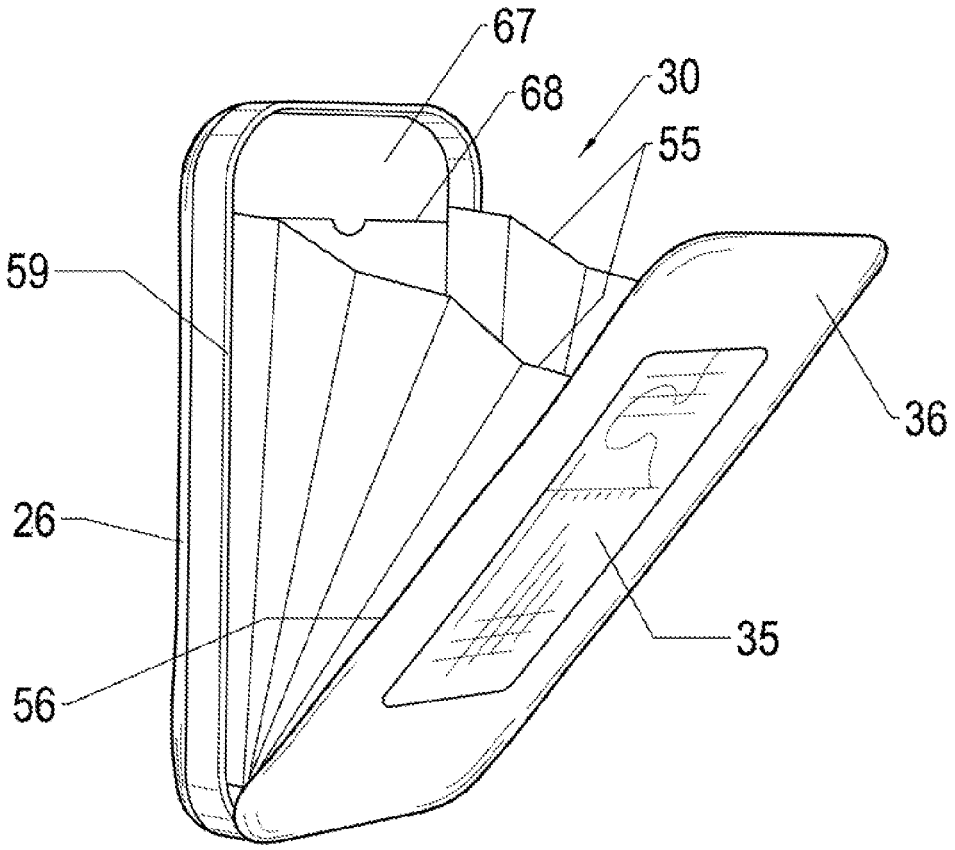
FIG. 27 is a back perspective view from the eyeglass/storage compartment side showing the eleventh embodiment of the present invention.
Figure 28:
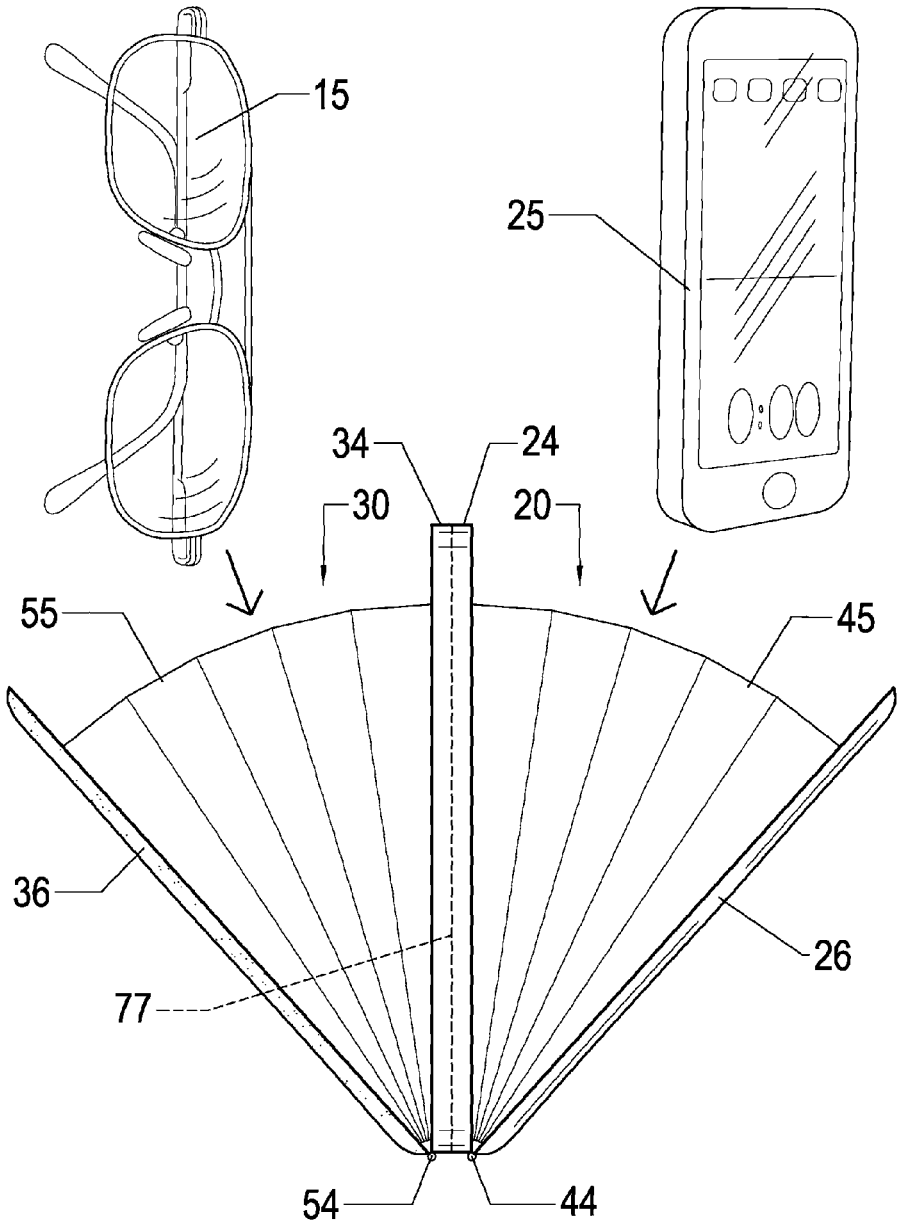
FIG. 28 is a side view showing the eleventh embodiment of the present invention.

FIGS. 23-24 illustrate a resilient insert 66 that is sized and configured to fit within the rearward portion of the phone housing compartment 20. The resilient insert 66 serves to hold phone 25 securely against the transparent access window 40 to facilitate transmission of the manual touch on the outside of window 40 to the touchscreen of the contained phone 25. The resilient insert 66 preferably is closely fitted to the size of the rearward portion of the phone housing compartment 20 so that it may be frictionally engaged and does not require further engagement mechanisms. Optionally, an adhesive backing may be disposed on the back surface of resilient insert 66 to adhere the insert 66 to the front surface of back wall 28. If an adhesive backing is provided, an optional adhesive protective sheet may be adhered to the adhesive backing and may be manually removable by the user. A single resilient insert 66 can be included with the purchase of a single combination cell phone and eyeglass case 10, but preferably two or more resilient inserts 66 are provided with the single combination cell phone and eyeglass case 10. Then the user can select the resilient insert 66 of the appropriate width that will allow easy insertion of the phone 25 into the phone housing compartment 20, but will also encourage the phone 25 front touchscreen to be adjacent to the transparent access window 40. The unused resilient inserts 66 may be simply discarded or may be repurposed. The resilient insert 66 may be formed of a conventional resilient material, such as open or closed foam rubber or the like. Though designed for use within the back portion of the phone housing compartment 20, the resilient insert 66 may additionally be used as an insert within the back of the eyeglass/storage compartment 30 to cushion its contents.

As seen in FIGS. 18-21, the eyeglass/storage compartment 30 (in similarity with the phone housing compartment 20) has an interior compartment with side bellows 55. The eyeglass/storage compartment 30 comprises an eyeglass/storage bottom wall 31 (FIG. 20), two opposing eyeglass/storage side walls 39, eyeglass/storage bellows 55, an eyeglass/storage front wall 36, and a back wall (either a shared back wall 77 or eyeglass/storage back wall 38). A bottom eyeglass/storage hinge 54 joins the eyeglass/storage bottom wall 31 to the eyeglass/storage front wall 36. The eyeglass/storage compartment 30 may have an open top, as shown in FIGS. 3-4, but preferable has a closed top and includes an eyeglass/storage top wall 34.

The eyeglass/storage front wall 36 forms the forward or outward most portion of the eyeglass/storage compartment 30. The eyeglass/storage front wall 36 may be generally planar as in FIG. 18 or may be somewhat rounded to provide a deeper eyeglass/storage compartment 30. The eyeglass/storage front wall 36 may optionally include a centrally disposed pocket with viewing window 35. The pocket with viewing window 35 has an interior pocket portion sized and configured to allow a driver's license or identification card to be inserted into the pocket with a viewing window exterior to the pocket, thereby allowing visual inspection of the contained driver's license from the exterior of the eyeglass/storage compartment 30. The interior pocket is preferably accessible from the inside of the eyeglass/storage compartment 30. The viewing window 35 may be formed of polyethylene terephthalate (PET), polyurethane, polyvinylchloride (PVC), polypropylene or other polymerics. The back portion of the eyeglass/storage front wall 36 ends in an inward-facing back edge 56 that extends across the top, along a first side, across the bottom, and along a second side of the eyeglass/storage front wall 36.

The inside back of the eyeglass/storage compartment 30 may be a phone housing back wall 28 or a shared common wall 77. Shared common wall 77 may be formed unitarily functionally including both the phone housing back wall 28 and eyeglass/storage back wall 38. Shared common wall 77 may also be formed by adhering two separate walls, phone housing back wall 28 and eyeglass/storage back wall 38. In the shared common wall 77 as seen in FIGS. 16-19, the eyeglass-facing side forms the back interior wall of the eyeglass/storage compartment 30. In another aspect the eyeglass/storage back wall 38 is adjacent to the phone housing back wall 28 forming a double wall, as seen in FIG. 21.

The shared back wall 77 or eyeglass/storage back wall 38 is fixedly attached to the eyeglass/storage top wall 34, to eyeglass/storage bottom wall 31, and to opposing eyeglass/storage side walls 39 to form the back, top, bottom and sides of the rearward portion of the eyeglass/storage compartment 30. Optionally, this rearward portion of the eyeglass/storage compartment 30 may receive an insert 67, 69 (FIGS. 22, 31) discussed below. Both opposing eyeglass/storage side walls 39 have an outward-facing edge 59. The eyeglass/storage top wall 34 has an outward-facing edge, and the eyeglass/storage bottom wall 31 has an outward-facing edge.

When the eyeglass/storage compartment 30 is closed, as in FIGS. 20-21, the eyeglass/storage inward-facing back edge 56 is adjacent to the outward-facing edges of the side walls 39, bottom wall 31 and top wall 34. As can be seen while looking at FIGS. 16 and 18 together, the lower portion of eyeglass/storage front wall 36 is rotatably attached by the eyeglass/storage hinge 54 (FIGS. 20-21) to the lower portion of eyeglass/storage bottom wall 31. The eyeglass/storage front wall 36 is movable from a closed position (see FIG. 16) wherein the eyeglass/storage compartment 30 is closed with the eyeglass/storage bellows 55 folded and shut inside to an open position (see FIG. 18) wherein the eyeglass/storage bellows 55 are extended and the eyeglass/storage compartment 30 is opened to allow access for storage of eyeglasses 15 or other personal gear. The spring action of the hinge 54 is preferably robust enough to maintain the eyeglass/storage compartment 30 in the closed position until manually opened. Optionally, an eyeglass/storage grip 57 (FIG. 16) disposed at eyeglass/storage top wall 34 may be included. As described above in relation to the phone housing grip 47 (FIG. 16), the eyeglass/storage grip 57 may be a finger-receiving indentation within the eyeglass/storage top wall 34 or may be of a latch type to secure the eyeglass/storage front wall 36 to the eyeglass/storage top wall 34.

The eyeglass/storage hinge 54 may be configured similarly to the phone housing hinge 44 as described above. The eyeglass/storage hinge 54 has a bottom wall hinge leaf 52 positioned in a general horizontal configuration along eyeglass/storage bottom wall 31, as seen in FIGS. 21, 29, and has an eyeglass/storage front wall hinge leaf 51 curved to follow the contour of eyeglass/storage front wall 36. The hinge leaves 51, 52 may be fixedly attached to an outward (FIG. 29) or inward (FIG. 21) portion of eyeglass/storage front wall 36 and to an outward (FIG. 29) or inward (FIG. 21) portion of eyeglass/storage bottom wall 31. Due to the close configuration of the two hinges 44, 54 it may be desirable for the bottom hinge leaves 42, 52 of the phone housing hinge 44 and of the eyeglass/storage hinge 54, respectively, to overlap each other, but if space allows this may not be necessary. Optionally, the hinges 44, 45 may be a unitary three part hinge with two upwardly curved leaves 41, 51 and with a single intermediary unitary leaf (the combination of 42 joined to 52). The unitary leaf 42/52 provides a larger and more robust point of attachment for the two leaves 41, 51. The unitary leaf 42/52 extends between the center of phone housing hinge 44 to the center of the eyeglass/storage hinge 54 with the curved leaf 41 attached to the center of phone housing hinge 44 and extending upwardly (on the right in FIGS. 17, 21) and with the curved leaf 51 attached to the center of the eyeglass/storage hinge 54 and extending upwardly (on the left in FIGS. 17, 21).

The eyeglass/storage bellows 55 are configured similarly to the phone housing bellows 45 described above. The eyeglass/storage bellows 55 on each side extend between the eyeglass/storage side wall outward-facing edge 59 and the eyeglass/storage front wall back edge 56 of that side. The eyeglass/storage bellows 55, as described above, are fixedly attached to side wall 39 and front wall 36 and are preferably pleated.

Figure 22:
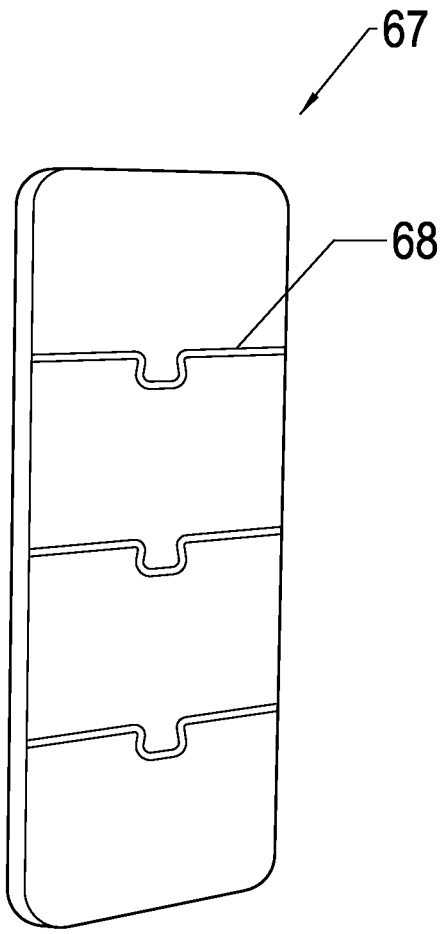
FIG. 22 is a front perspective view of a credit card insert usable in the eyeglass/storage compartment 30 of the tenth and eleventh embodiments of the present invention.
Figure 31:
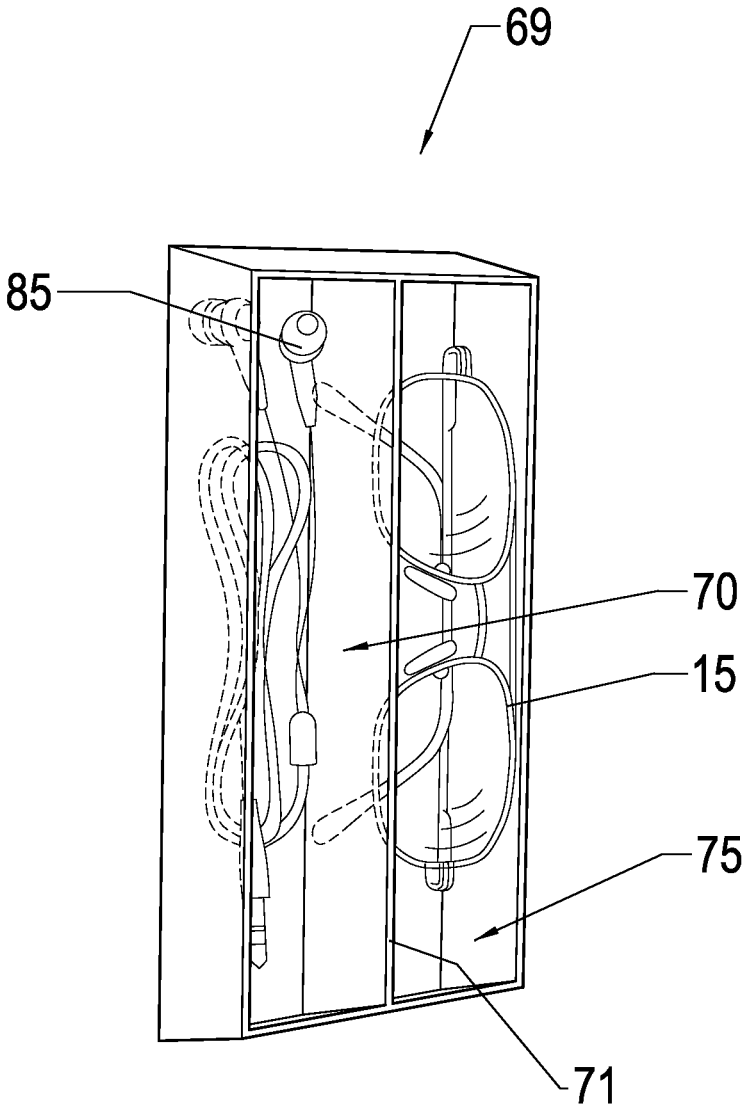
FIG. 31 is a front perspective view of a dual section insert usable in the tenth and eleventh embodiments of the present invention.

FIG. 22 and FIG. 31 illustrate inserts that are configured to fit within the eyeglass/storage compartment 30.

FIG. 22 illustrates a card insert 67 that is configured with multiple pockets 68, such as to hold credit cards, gift cards, identification cards or the like. Pockets 68 may be slid-in pockets, as illustrated, or, one or more pockets 68 may have a closure such as a snap or zipper.

FIG. 31 illustrates a provided sectional insert 69, shown with two sections, but which may have one or multiple sections, that includes a first section 70 and a second section 75 that are separated by a center wall 71. The sectional insert 69 is designed for containing accessories, preferably two or more separate accessories, such as eyeglasses 15, earbuds 85, pens, erasers, small containers (such as for pills or lotions) or other similar personal accessories.

The back portions of both card insert 67 and sectional insert 69 may be closely fitted to the size of the rearward portion of the eyeglass/storage compartment 30 so that they may be frictionally engaged and do not require further engagement mechanisms. However, an adhesive backing may be disposed on the back surface of inserts 67, 69 to adhere the inserts 67, 69 to the front surface of the eyeglass/storage back wall 38 (and an adhesive backing protective cover may be provided, if desired). One or both inserts may be provided with the single combination cell phone and eyeglass case 10 to allow the user to choose the insert 67, 69 that best fits his or her needs and to optionally adhere the selected insert within the back of the compartment 30.

In this tenth embodiment, most of the combination case 10 may be constructed from generally rigid materials, such as rigid polymeric materials, as are well known in the construction of eyeglasses cases. However, any known construction materials for eyeglass cases, such as covered sheet metal, would be equally applicable. The rigid materials may form most or all of the phone housing bottom wall 21, phone housing top wall 24, phone housing front wall 26 (exclusive of the transparent access window 40), opposing phone housing side walls 29, eyeglass/storage bottom wall 31, phone housing back wall 28, eyeglass/storage top wall 34, eyeglass/storage front wall 36 (exclusive of the optional viewing window of pocket 35), opposing eyeglass/storage side walls 39, and the back wall (either shared common back wall 77 or phone housing back wall 28 in combination with eyeglass/storage back wall 38).

In contrast, a significant portion of the combination case 10 of the eleventh embodiment shown in FIGS. 25-30 may be formed of a softer material, such as natural leather, imitation leather, or a flexible polymeric material. In the eleventh embodiment, the softer material expands somewhat to accommodate the width of the accessories inserted. For instance, in FIG. 26 the phone 25 is inserted into the phone housing compartment 20 and rests upon resilient insert 66. When the eyeglass/storage front wall 36 is rotated closed, the front of the phone 25 is lightly forced against the phone housing front wall 26, thereby holding the transparent access window 40 within front wall 26 taut against the touchscreen of the phone 25. After multiple insertions, the phone 25 may even create a slight indention within the insert 66, but the flexibility of the material of the eyeglass/storage front wall 36 (and possibly to some extent of the transparent access window 40) allows the transparent access window 40 to be snugged against the front touchscreen surface of the phone 25.

In the eleventh embodiment of FIGS. 25-30 there may additionally be a supportive frame to which the softer, flexible material is fixedly attached. For instance, a frame may be disposed at the phone housing front wall inward-facing back edge 46 (FIG. 26) and the eyeglass/storage front wall back edge 56 (FIG. 27) onto which the softer, flexible material is attached. The frame may be formed of a rigid polymeric or metal material.

A combination of the more rigid material of the tenth embodiment may be used with the softer material of the eleventh embodiment. For example, the side walls 26, 36, top walls 24, 34, and bottom walls 21, 31 may be formed of a more rigid material with the front walls 26, 36 formed of a more flexible material.

The eleventh embodiment of FIGS. 25-30 also provides a connection attachment 63 (FIG. 30), such as a ring or loop for receiving a strap, a keychain or the like. The connection attachment 63 is fitted through a connection aperture with connection aperture edges 64 defining the boundaries of the connection aperture. The connection aperture edges 64 may be fitted with an optional grommet for robustness. The diameter of the connection aperture may be, for example, from 1 mm to 10 mm. The connection aperture may be disposed within either the phone housing compartment 20 or the eyeglass/storage compartment 30, but is preferably disposed within the eyeglass/storage compartment 30 in a portion of the compartment 30 that is generally less used when eyeglasses are received within the compartment 30, such as in a top or bottom corner of the compartment 30.

In other aspects the eleventh embodiment of FIGS. 25-30 is structurally and functionally similar to the tenth embodiment of FIGS. 16-22.

The twelfth embodiment of the combination cell phone and eyeglass case 10 is shown in FIGS. 32-34 and the thirteenth embodiment is shown in FIGS. 33-35. In both the twelfth and thirteenth embodiments, the phone 25 is inserted through an interior opening with a flap 80 folded over the opening and secured by a latching mechanism 73. The opening is defined by phone-receiving slot edges 84, 86. The flap of the twelfth embodiment incorporates the transparent access window 40 while the flap of the thirteenth embodiment incorporates card-receiving slots 81. As in the tenth and eleventh embodiments a longitudinal axis running through the middle of phone housing compartment 20 is generally parallel to a longitudinal axis running through the middle of the eyeglass/storage compartment 30. However, the eyeglass/storage top opening edge 33 and the phone-receiving slot edges 84, 86 are not oriented in the same direction.

The combination cell phone and eyeglass case 10 of the present invention has been shown in numerous and varied exemplary embodiments having an eyeglass/storage compartment 30 and an adjacent phone housing compartment 20 to form the combination cell phone and eyeglass case 10 that functions to hold the juxtaposed cell phone and eyeglasses. The features and variations described and their equivalents can be utilized together or separately in a wide variety of combinations in designing and manufacturing the combination cell phone and eyeglass case 10. Variations may be desirable for functional and/or aesthetic reasons. These may include, for example, variations in one or more of the following: variations in aesthetic ornamentation (such as embellishments, designs, patterns or logos, coloring, embroidery, stamping, printing); the inclusion, omission, and type of any case attachment 17 (FIG. 7); the inclusion, omission, and type of lining 44 (FIG. 7); variations in the longitudinal phone housing axis 50 orientation in relation to the longitudinal eyeglass/storage axis 60; variations in the orientation of the eyeglass/storage top opening edge 33 in relation to the phone housing top opening edge 23; the type of permanent joining mechanism 11 used; the inclusion or omission of a top lid 13; the inclusion of or type of cap-retaining aid 14; the angularity or curvature of the eyeglass/storage compartment 30; the angularity or curvature of the phone housing compartment 20; the inclusion, omission, or height of any upper back extension 22; the particular wall of the eyeglass/storage compartment 30 that is permanently joined to the particular wall of the phone housing compartment 20; the spacing, if any, between the eyeglass/storage compartment and the phone housing compartment; the inclusion or omission of a pocket with a viewing window 35; the inclusion or omission of a transparent access window 40; and the inclusion or omission of side bellows 45, 55.

The combination cell phone and eyeglass case 10 of the present invention may be manufactured in a variety of sizes to correspond to conventional sizes of cellular phones and eyeglasses. The combination cell phone and eyeglass case 10 may be manufactured and distributed in a limited number of sizes, such as in a small and large size or in three or four sizes, to optimize sales while minimizing retail shelf space. For example, the length of the case 10 is preferably between 10 cm and 18 cm, the depth of the case 10 is preferably between 1.5 cm and 9 cm, and the width of the case 10 is preferably between 7 cm and 11 cm.

All or a portion of the combination cell phone and eyeglass case 10 may be formed of any natural or manmade material that is suitable for cases, luggage, purses or other bags, such as, for example, natural leather, leatherette, neoprene, nylon, cotton, polyester, canvas and any of a variety of plastics, including a semi-rigid molded plastic. Optionally, the combination cell phone and eyeglass case 10 may be formed of a combination of materials, chosen based on functional or aesthetic reasons. The walls of the eyeglass/storage compartment and of the phone housing compartment may be formed integrally or one or more may be formed separately and permanently joined using conventional case-making and luggage-making techniques, as are known in the art.

The compact design provides advantages to the manufacturer, distributor and retailer by minimizing materials used for manufacture, transportation costs and shelf display space. Also, the compact design allows the user to easily insert the case 10 into a bag, purse, briefcase or the like that is already in his or her possession.

To use the combination cell phone and eyeglass case 10 of the present invention, the user stores his or her phone 25 (or other handheld consumer device) within the phone housing compartment 20 and stores a pair of eyeglasses 15 in the eyeglass/storage compartment 30. Using the transparent access window 40 of the tenth through thirteenth embodiments, the user may contact the front touchscreen of an enclosed phone to answer the phone or perform other tasks at times with or without removing the phone, but when needed, the phone is quick and easy to extract. The eyeglasses are similarly easy to remove from the eyeglass/storage compartment 30 when needed. If the user does not wish to store eyeglasses within compartment 30, it may be utilized for other personal accessories. Optionally, to personalize the case 10 the user may place a provided insert 66, 67, 69 within one or both compartments 20, 30.

Since many modifications, variations and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A dual-compartment case, comprising:

a phone housing compartment (20) comprising a phone housing bottom wall (21), a phone housing top wall (24), a phone housing front wall (26), two opposing phone housing side walls (29), a common back wall (77), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44); and wherein said phone housing hinge (44) comprises a spring hinge; and an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54); and wherein said eyeglass/storage hinge (54) comprises a spring hinge.

2. The dual-compartment case, as recited in claim 1 wherein:

said phone housing hinge (44) comprises a phone housing front wall hinge leaf (41) and phone housing bottom wall hinge leaf (42);

said phone housing front wall hinge leaf (41) is curved to follow the contour of said phone housing front wall (26);

said eyeglass/storage hinge (54) comprises an eyeglass/storage front wall hinge leaf (51) and an eyeglass/storage bottom wall hinge leaf (52); and said eyeglass/storage front wall hinge leaf (51) is curved to follow the contour of said eyeglass/storage front wall (36).

3. The dual-compartment case, as recited in claim 1 wherein:

said phone housing hinge (44) and said eyeglass/storage hinge (54) are formed as a unitary hinge comprising: a phone housing front wall hinge leaf (41), a unitary bottom wall hinge leaf (42/52), and an eyeglass/storage front wall hinge leaf (51);

said unitary bottom wall hinge leaf (42/52) extends from the center of said phone housing hinge (44) to the center of said eyeglass/storage hinge (54);

said phone housing front wall hinge leaf (41) is curved to follow the contour of said phone housing front wall (26); and said eyeglass/storage front wall hinge leaf (51) is curved to follow the contour of said eyeglass/storage front wall (36).

4. The dual-compartment case, as recited in claim 1, wherein said dual-compartment case (10) further comprises at least one of eyeglass/storage bellows (55) or phone housing bellows (45).

5. The dual-compartment case, as recited in claim 1, wherein said dual-compartment case (10) further comprises at least one connection attachment (63).

6. A dual-compartment case comprising:

a phone housing compartment (20) comprising a phone housing bottom wall (21), a phone housing top wall (24), a phone housing front wall (26), two opposing phone housing side walls (29), a common back wall (77), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44); and wherein said phone housing front wall (26) comprises a centrally disposed transparent access window (40) formed of a substantially transparent material; and an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54).

7. The dual-compartment case, as recited in claim 6, wherein said eyeglass/storage compartment (30) further comprises at least one of eyeglass/storage bellows (55) or phone housing bellows (45).

8. The dual-compartment case, as recited in claim 6, wherein said dual-compartment case (10) further comprises at least one connection attachment (63).

9. A dual-compartment case comprising:

a phone housing compartment (20) comprising a phone housing bottom wall (21), a phone housing top wall (24), a phone housing front wall (26), two opposing phone housing side walls (29), a common back wall (77), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44); and wherein said eyeglass/storage front wall (36) comprises a centrally disposed interior pocket and a centrally disposed viewing window (35) aligned with said interior pocket to allow viewing an item placed within said interior pocket, wherein said viewing window is formed of a substantially transparent material; and an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54).

10. The dual-compartment case, as recited in claim 9, wherein said eyeglass/storage compartment (30) further comprises at least one of eyeglass/storage bellows (55) or phone housing bellows (45).

11. The dual-compartment case, as recited in claim 9, wherein said dual-compartment case (10) further comprises at least one connection attachment (63).

12. A dual-compartment case comprising:

a phone housing compartment (20) comprising a phone housing bottom wall (21), a phone housing front wall (26), two opposing phone housing side walls (29), a common back wall (77), a phone housing top wall (24), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44);

an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54); and at least one resilient insert (66) that is sized to fit within the back of said phone housing compartment (20) and is sized to extend from said phone housing top wall (24) to said phone housing bottom wall (21) and to extend between said two opposing phone housing side walls (29).

13. The dual-compartment case, as recited in claim 12, further comprising a phone housing top wall (24), and wherein said at least one resilient insert (66) comprises a cushioned front portion and an adhesive back portion, whereby a user can manually attach said at least one resilient insert (66) within the back of said phone housing compartment (20).

14. A dual-compartment case comprising:

a phone housing compartment (20) comprising a phone housing bottom wall (21), a phone housing top wall (24), a phone housing front wall (26), two opposing phone housing side walls (29), a common back wall (77), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44);

an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54); and at least one card insert (67) that is sized to fit within the back of said eyeglass/storage compartment (30) and is sized to extend from said phone housing top wall (24) to said eyeglass/storage bottom wall (31) and to extend between said two opposing eyeglass/storage side walls (39), wherein said card insert (67) comprises at least one pocket (68) accessible from the front of said card insert (67).

15. The dual-compartment case, as recited in claim 14, wherein said eyeglass/storage compartment (30) further comprises at least one of eyeglass/storage bellows (55) or phone housing bellows (45).

16. The dual-compartment case, as recited in claim 14, wherein said dual-compartment case (10) further comprises at least one connection attachment (63).

17. A dual-compartment case comprising:

a phone housing compartment (20) comprising a phone housing bottom wall (21), a phone housing top wall (24), a phone housing front wall (26), two opposing phone housing side walls (29), a common back wall (77), and a phone housing hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44);

an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36) via said eyeglass/storage hinge (54); and at least one sectional insert (69) that is sized to fit within the back of said eyeglass/storage compartment (30) and is sized to extend from said phone housing top wall (24) to said eyeglass/storage bottom wall (31) and to extend between said two opposing eyeglass/storage side walls (39), wherein said sectional insert (69) includes at least one section open to the front of said sectional insert (69).

18. The dual-compartment case, as recited in claim 17, wherein said eyeglass/storage compartment (30) further comprises at least one of eyeglass/storage bellows (55) or phone housing bellows (45).

19. The dual-compartment case, as recited in claim 17, wherein said dual-compartment case (10) further comprises at least one connection attachment (63).

20. A dual-compartment case, comprising:

a phone housing compartment (20) comprising a phone housing bottom wall (21), a phone housing top wall (24), a phone housing front wall (26), two opposing phone housing side walls (29), a common back wall (77), and a phone housing spring-type hinge (44); wherein a first side top portion of said common back wall (77) is fixedly attached to an inward portion of said phone housing top wall (24); wherein a first side bottom portion of said common back wall (77) is fixedly attached to an inward portion of said phone housing bottom wall (21); wherein said phone housing bottom wall (21) is hingedly attached to said phone housing front wall (26) via said phone housing hinge (44); wherein said phone housing spring-type hinge (44) comprises a phone housing front wall hinge leaf (41) curved to follow the contour of said phone housing front wall (26); wherein said phone housing compartment (20) further comprises phone housing bellows (45) fixedly attached to said phone housing side wall (29) and phone housing front wall (26); wherein said phone housing front wall (26) comprises a centrally disposed transparent access window (40) formed of a substantially transparent material; and wherein said phone housing front wall (26) comprises a centrally disposed transparent access window (40) formed of a substantially transparent material; and an eyeglass/storage compartment (30) attached to a second side of said common back wall (77); wherein said eyeglass/storage compartment (30) comprises an eyeglass/storage bottom wall (31), an eyeglass/storage top wall (34), an eyeglass/storage front wall (36), two opposing eyeglass/storage side walls (39), and an eyeglass/storage spring-type hinge (54); wherein a second side top portion of said common back wall (77) is fixedly attached to an inward portion of said eyeglass/storage top wall (34); wherein a second side bottom portion of said common back wall (77) is fixedly attached to an inward portion of said eyeglass/storage bottom wall (31); wherein said eyeglass/storage bottom wall (31) is hingedly attached to said eyeglass/storage front wall (36), via said eyeglass/storage hinge (54); wherein said eyeglass/storage compartment (30) further comprises eyeglass/storage bellows (55) fixedly attached to said eyeglass/storage side wall (39) and eyeglass/storage front wall (36); and wherein said eyeglass/storage spring-type hinge (54) comprises an eyeglass/storage front wall hinge leaf (41) curved to follow the contour of said eyeglass/storage front wall (36).

21. The dual-compartment case, as recited in claim 20 wherein:

said phone housing hinge (44) and said eyeglass/storage hinge (54) are formed as a unitary hinge comprising a unitary bottom wall hinge leaf (42/52); and said unitary bottom wall hinge leaf (42/52) extends from the center of said phone housing hinge (44) to the center of said eyeglass/storage hinge (54).

* * * * *